US008369543B2

(12) United States Patent
Suzuki et al.

(10) Patent No.: US 8,369,543 B2
(45) Date of Patent: Feb. 5, 2013

(54) SPEAKER DEVICE AND SPEAKER-EXCITATION METHOD

(75) Inventors: Nobukazu Suzuki, Kanagawa (JP); Masaru Uryu, Chiba (JP); Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1337 days.

(21) Appl. No.: 12/009,425

(22) Filed: Jan. 18, 2008

(65) Prior Publication Data

US 2008/0175416 A1 Jul. 24, 2008

(30) Foreign Application Priority Data

Jan. 22, 2007 (JP) ..... 2007-011088

(51) Int. Cl.
*H04R 25/00* (2006.01)

(52) U.S. Cl. ..... 381/150; 381/152; 381/337; 381/345; 381/161; 381/191; 381/386

(58) Field of Classification Search ..... 381/150, 381/152, 337, 345, 161, 162, 191, 386
See application file for complete search history.

(56) References Cited

U.S. PATENT DOCUMENTS

| | | | | |
|---|---|---|---|---|
| 7,106,881 | B2 * | 9/2006 | Backman | 381/408 |
| 2004/0240687 | A1 | 12/2004 | Graetz | |
| 2004/0251747 | A1 | 12/2004 | Bouchard | |
| 2008/0000715 | A1 * | 1/2008 | Bouvier | 181/156 |

FOREIGN PATENT DOCUMENTS

| | | |
|---|---|---|
| JP | 04-313999 | 11/1992 |
| JP | 07-007777 A | 1/1995 |
| JP | 11-113088 A | 4/1999 |
| JP | 2005-502288 | 1/2005 |
| JP | 2006-526950 | 11/2006 |
| JP | 2007-166027 | 6/2007 |

* cited by examiner

*Primary Examiner* — Ha Tran T Nguyen
*Assistant Examiner* — Suberr Chi
(74) *Attorney, Agent, or Firm* — Wolf, Greenfield & Sacks, P.C.

(57) ABSTRACT

A speaker device includes an acoustic-vibration member, an actuator that is driven on the basis of a sound signal and that includes a displacement-output unit that can obtain the displacement corresponding to the sound signal, and a displacement-output-transfer member configured to connect the displacement-output unit to a point predetermined on a face of the acoustic-vibration member. A displacement output of the actuator is transferred to the predetermined point via the displacement-output-transfer member, and the acoustic-vibration member is excited in a face direction from the predetermined point according to the displacement output.

15 Claims, 18 Drawing Sheets

SPEAKER DEVICE AND SPEAKER-EXCITATION METHOD

CROSS REFERENCES TO RELATED APPLICATIONS

The present invention contains subject matter related to Japanese Patent Application JP 2007-011088 filed in the Japanese Patent Office on Jan. 22, 2007, the entire contents of which are incorporated herein by reference.

BACKGROUND OF THE INVENTION

1. Field of the Invention

The present invention relates to a speaker device and a speaker-excitation method, and particularly relates to a speaker device and a speaker-excitation method that are provided so that a displacement output of an actuator is transferred to a point predetermined on the face of an acoustic diaphragm via a displacement-output-transfer member and the acoustic diaphragm is excited from the predetermined point in the face direction according to the displacement output of the actuator, which makes it possible to obtain a sound image with a feeling of spaciousness, obtain a sound output faithful to a sound signal, and increase flexibility in selecting the shape of the acoustic diaphragm.

2. Description of the Related Art

Heretofore, sound-output devices configured to obtain a sound output by driving a diaphragm by using a magnetostrictive actuator have been known, as disclosed in Japanese Unexamined Patent Application Publication No. 4-313999. The magnetostrictive actuator is an actuator using a magnetostrictive element, where the shape of the magnetostrictive element is changed due to an external magnetic field given thereto.

FIG. 19 shows an example configuration of a sound-output device 300 including a magnetostrictive actuator 303. The sound-output device 300 includes a player 301, an amplifier 302, the magnetostrictive actuator 303, and a diaphragm 304. Here, the magnetostrictive actuator 303 and the diaphragm 304 generate a speaker device 305.

The player 301 reproduces data recorded onto a compact disk (CD), a mini disk (MD), a digital-versatile disk (DVD), etc., for example, and outputs a sound signal. The sound signal output from the player 301 is amplified by the amplifier 302, and transmitted to the magnetostrictive actuator 303. The magnetostrictive actuator 303 includes a drive rod 303*a* configured to transfer a displacement output. The tip of the drive rod 303*a* abuts the diaphragm 304.

The magnetostrictive actuator 303 drives the diaphragm 304 based on the sound signal. Namely, the drive rod 303*a* of the magnetostrictive actuator 303 is displaced according to the waveform of the sound signal, and the signal of the displacement is transferred to the diaphragm 304. Subsequently, it becomes possible to obtain the sound output corresponding to the sound signal from the diaphragm 304.

SUMMARY OF THE INVENTION

In the speaker device 305 of the sound-output device 300, the drive rod 303 of the magnetostrictive actuator 303 abuts the plate face of the diaphragm 304, and the diaphragm 304 is excited by a vibration component applied thereto in a direction perpendicular to the plate face thereof, so that a sound output is obtained.

In that case, since the diaphragm 304 is significantly excited at an excitation point determined thereon, a sound wave emitted from the excitation point is heard by an audience, as a sound significantly louder than a sound wave emitted from another position. As a result, a sound image is localized at the excitation point, which makes it difficult to obtain a sound image with the spaciousness feeling.

Accordingly, the present invention has been achieved to present a speaker device that can obtain a sound image with the spaciousness feeling and a sound output faithful to a sound signal, and increase the flexibility in selecting the shape of an acoustic diaphragm.

A speaker device according to an embodiment of the present invention includes an acoustic-vibration member, an actuator that is driven on the basis of a sound signal and that includes a displacement-output unit that can obtain the displacement corresponding to the sound signal, and a displacement-output-transfer member configured to connect the displacement-output unit to a point predetermined on a face of the acoustic-vibration member, wherein a displacement output of the actuator is transferred to the predetermined point via the displacement-output-transfer member, and the acoustic-vibration member is excited in a face direction from the predetermined point according to the displacement output.

The above-described speaker device includes the acoustic-vibration member, the actuator, and the displacement-output-transfer member. The actuator is driven based on the sound signal. The displacement output of the actuator is transferred to the point predetermined on the face of the acoustic-vibration member via the displacement-output-transfer member. Then, the acoustic-vibration member is excited from the point predetermined on the face in the face direction according to the displacement output of the actuator. Here, the term "face direction" of the acoustic-vibration member denotes a direction parallel to the face of the acoustic-vibration member. The actuator may be provided, as a magnetostrictive actuator, an electrodynamic actuator, a piezoelectric actuator, etc.

When the acoustic-vibration member such as an acoustic diaphragm is excited in the face direction, an elastic wave generated based on the sound signal is propagated through the acoustic diaphragm in the face direction. Then, when the elastic wave is propagated through the acoustic diaphragm, mode is repeatedly changed so that longitudinal waves and transverse waves are generated alternately. Subsequently, a mixed wave including the longitudinal wave and the transverse wave is generated, and a vibration in the in-face direction (a direction vertical to the face) of the acoustic diaphragm is excited by the transverse wave so that a sound wave is externally emitted from the face of the acoustic diaphragm, and a sound output can be obtained.

The acoustic diaphragm is excited in the face direction, no large transverse wave is generated at the excitation point, and a sound wave emitted from the excitation point is not heard, as a sound significantly louder than a sound wave emitted from another position, so that a sound image is localized over the entire acoustic diaphragm. Subsequently, it becomes possible to obtain a sound image with the spaciousness feeling.

Further, the displacement output of the actuator is transferred to the point predetermined on the face of the acoustic diaphragm via the displacement-output-transfer member. Therefore, the displacement output of the actuator can be transferred to the acoustic diaphragm more correctly than in the case where the displacement-output unit of the actuator simply abuts the end face of the acoustic diaphragm, and a sound output faithful to the sound signal can be obtained. Further, the acoustic diaphragm may be of another shape so that the acoustic diaphragm has no end face. Namely, the acoustic diaphragm may be a globular acoustic diaphragm, a box-shaped acoustic diaphragm, etc., which increases the flexibility in selecting the shape of the acoustic diaphragm.

For example, the displacement-output-transfer member includes an approximately U-shaped member connected to the displacement-output unit of the actuator, and a stick-like member configured to penetrate the approximately U-shaped member and the acoustic diaphragm when the end part of the acoustic diaphragm is inserted into the approximately U-shaped member so that the approximately U-shaped member and the acoustic diaphragm are connected to each other. In that case, the use of the approximately-U-shaped member allows for transferring the displacement output of the actuator to the point predetermined on the acoustic diaphragm (excitation point) from both sides of the acoustic diaphragm, so that transfer of the displacement output of the actuator can be performed with stability.

Further, the displacement-output-transfer member includes a stick-like member that penetrates the displacement-output unit of the actuator and the acoustic diaphragm so that the displacement-output unit and the acoustic diaphragm are connected to each other. In that case, the actuator can be provided on one of face sides of the acoustic diaphragm. The above-described configuration can be used for an acoustic-vibration member with no end part, that is, a globular acoustic-vibration member, a box-shaped acoustic-vibration member, etc.

For example, the speaker device further includes an energizing structure configured to energize the actuator in the face direction at all times. Here, parts of the acoustic diaphragm are made contact with the displacement-output-transfer member. After the acoustic diaphragm is used over a long time period, the contact parts are worn out, so that looseness occurs between the contact parts and the displacement-output-transfer member. In that case, the displacement-output-transfer member can be pressed against the acoustic diaphragm so that the acoustic diaphragm can be excited appropriately in the face direction.

For example, the actuator has a first displacement-output unit provided on one end side and a second displacement-output unit provided on another end side. The first and second displacement-output units are connected to first and second points specified on the acoustic diaphragm via the first and second displacement-output-transfer members. In that case, since the number of points where a single magnetostrictive actuator excites the acoustic diaphragm becomes two, the feeling of spaciousness of a sound image can be increased.

For example, a plurality of the actuators is provided. Displacement outputs of the actuators are transferred to different points specified on the face of the acoustic diaphragm via a plurality of the displacement-output-transfer members. For example, it becomes possible to achieve nondirectivity by driving the actuators based on the same sound signal. Further, for example, when the actuators are driven based on sound signals independent of each other such as sound signals of a plurality of channels, and/or a plurality of sound signals obtained by adjusting the level, delay time, frequency characteristic, etc. of the same sound signal, it becomes possible to perform sound-field processing, so as to increase the spaciousness feeling of a sound.

The present invention allows for transferring a displacement output of an actuator to a point predetermined on the face of an acoustic diaphragm via a displacement-output-transfer member and exciting the acoustic diaphragm from the predetermined point in the face direction according to the displacement output of the actuator, which makes it possible to obtain a sound image with the spaciousness feeling, obtain a sound output faithful to a sound signal, and increase flexibility in selecting the shape of the acoustic diaphragm.

DESCRIPTION OF THE PREFERRED EMBODIMENTS

Figure 1:
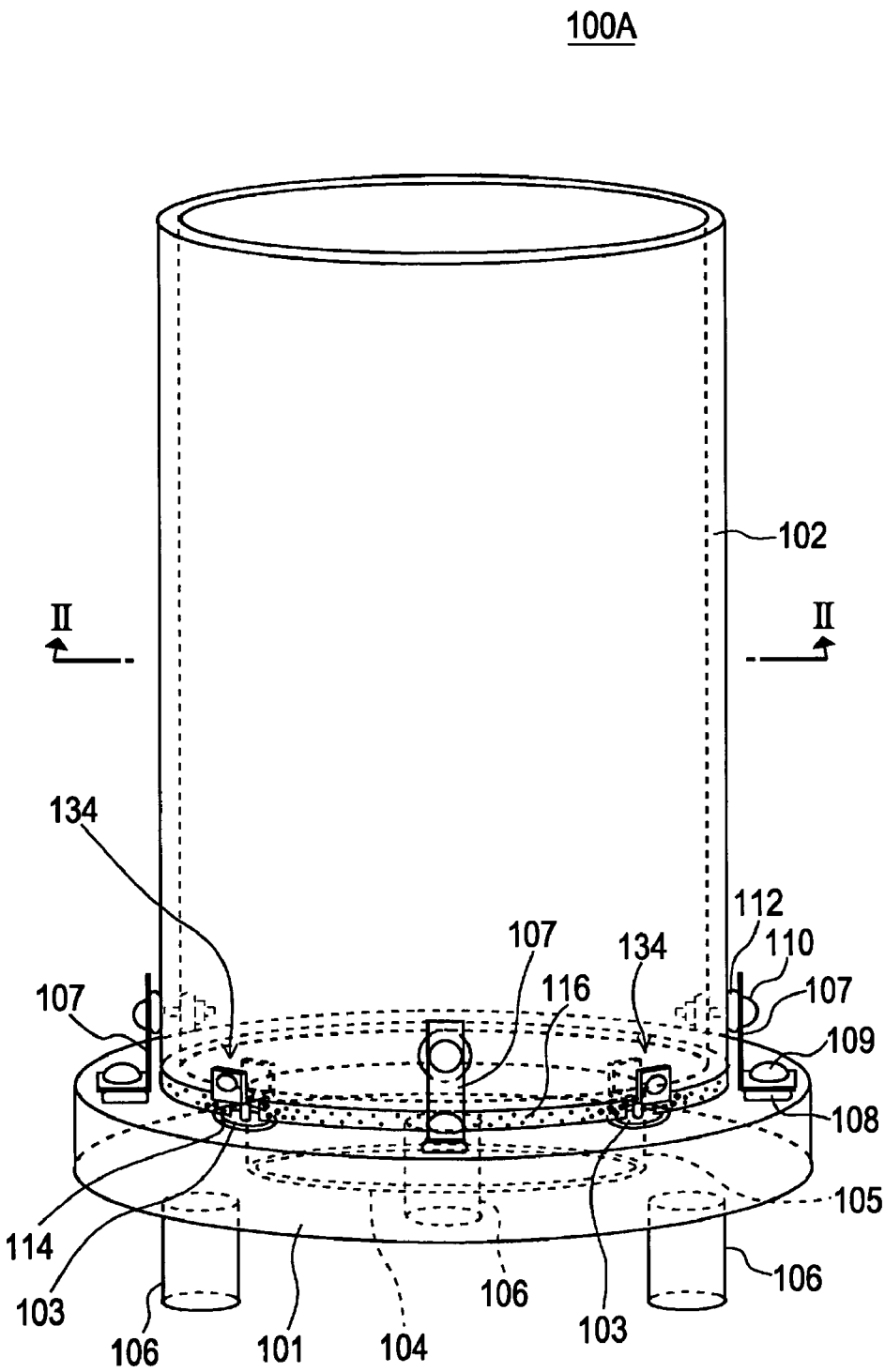
FIG. 1 is a perspective view of a speaker device according to an embodiment of the present invention.
Figure 2:
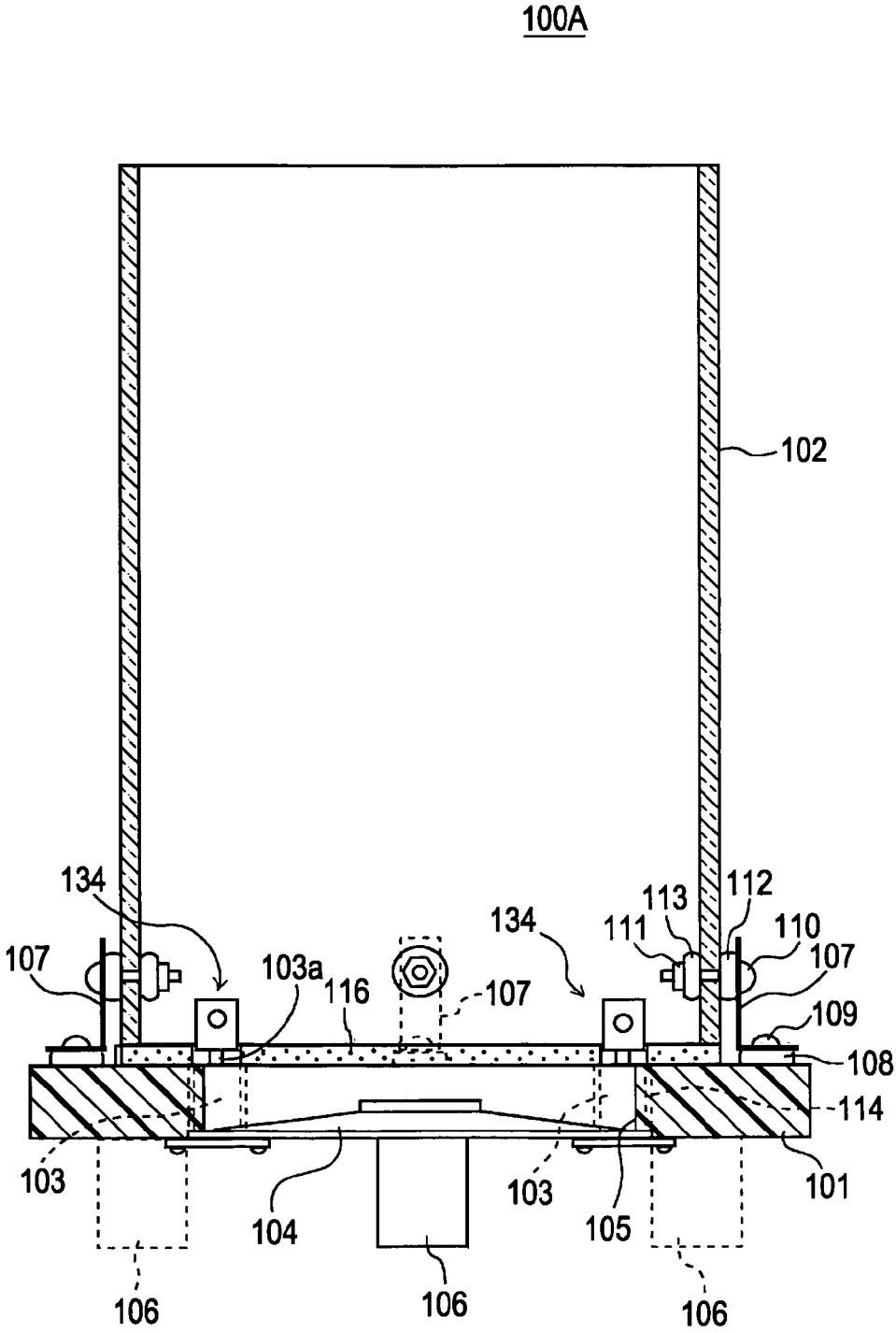
FIG. 2 is a longitudinal-sectional view of the speaker device shown in FIG. 1.
Figure 3:
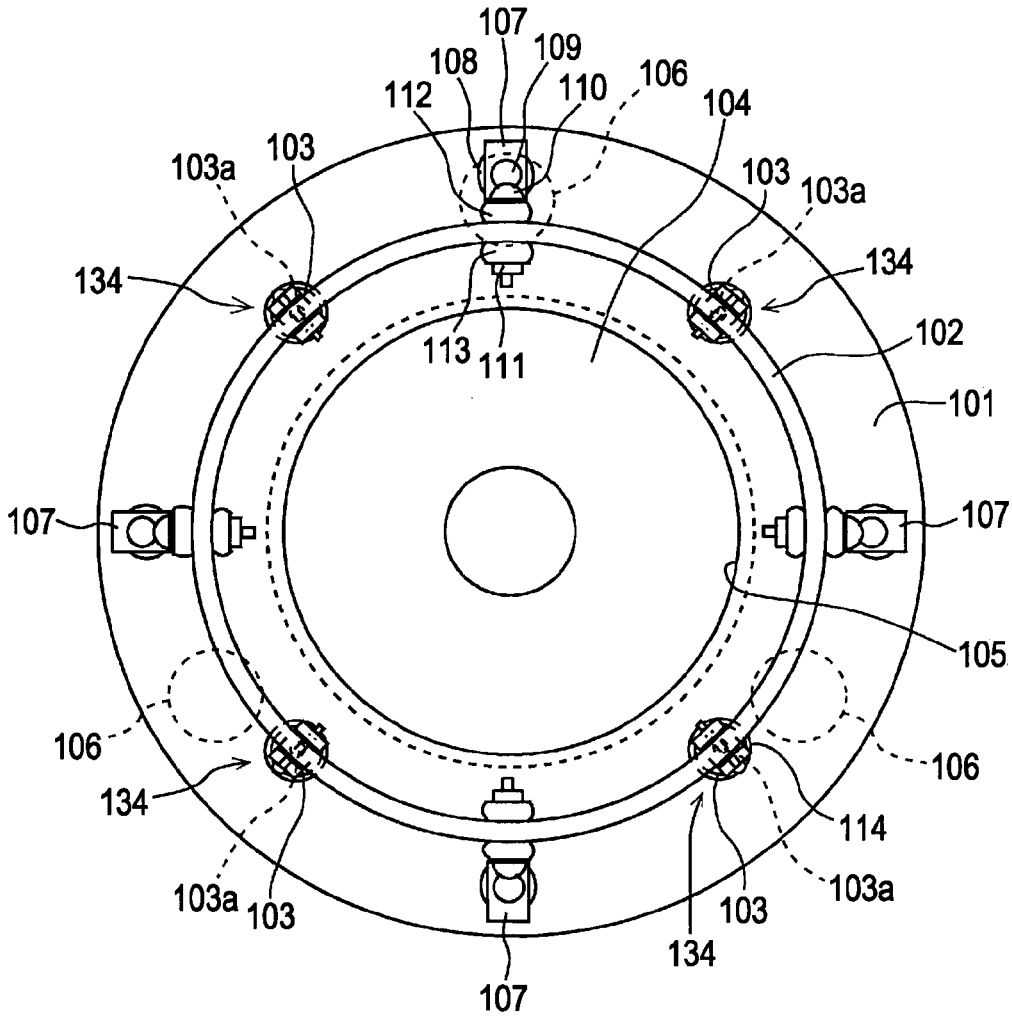
FIG. 3 is a topface view of the speaker device shown in FIG. 1.
Figure 4:
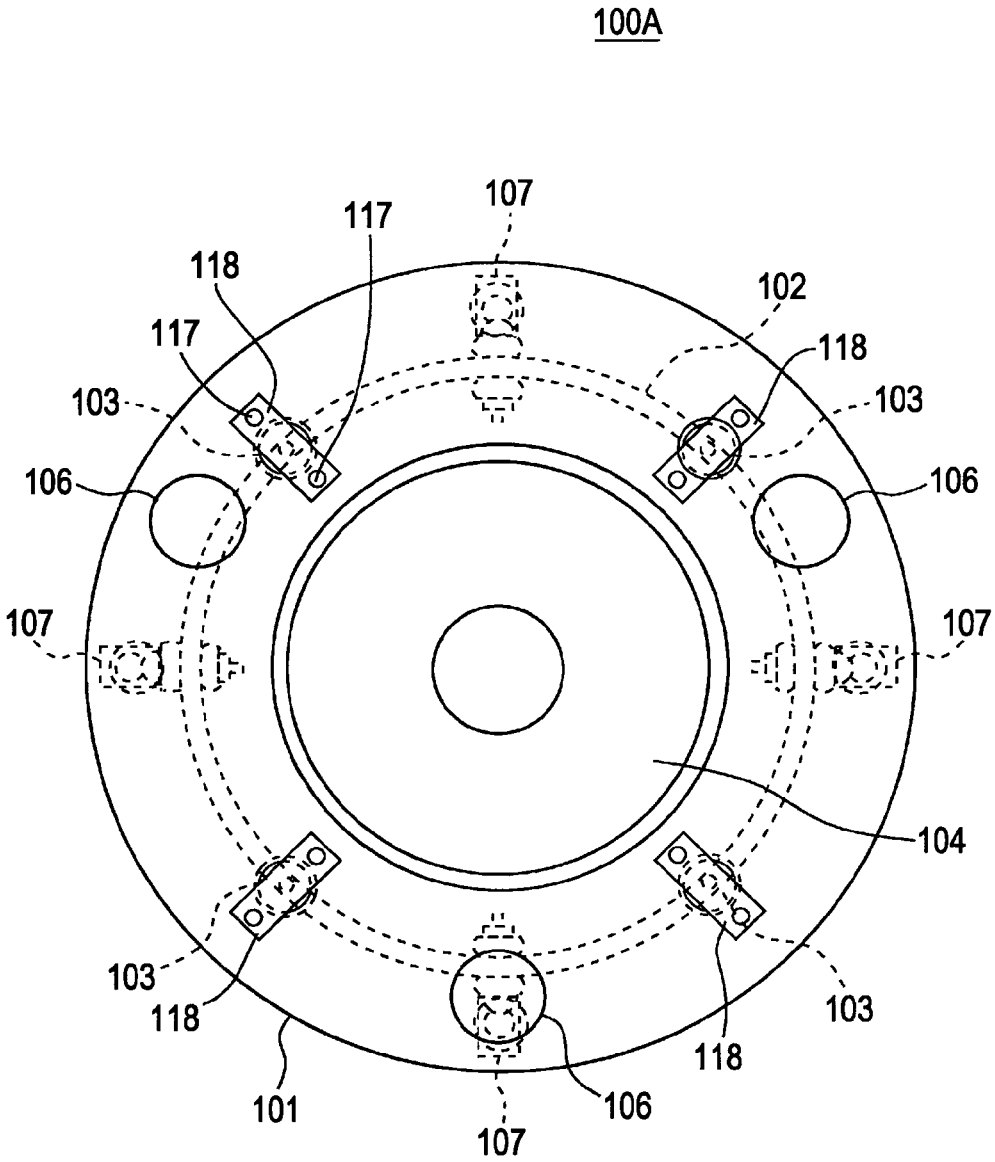
FIG. 4 is an underface view of the speaker device shown in FIG. 1.

Embodiments of the present invention will be described. Each of FIGS. 1, 2, 3, and 4 shows the configuration of a speaker device 100A according to an embodiment of the present invention. FIG. 1 is a perspective view of the speaker device 100A, FIG. 2 is a longitudinal-sectional view of the speaker device 100A cut along the line II-II, FIG. 3 is a topface view of the speaker device 100A, and FIG. 4 is an underface view of the speaker device 100A.

The speaker device 100A includes a base cabinet 101, a pipe 102, a magnetostrictive actuator 103 functioning, as an actuator, a displacement-output-transfer member 134, and a speaker unit 104 using an electrodynamic actuator functioning, as a sound-generation body. The pipe 102 is formed, as a cylindrical diaphragm functioning, as an acoustic diaphragm. A drive rod 103*a* of the magnetostrictive actuator 103 is formed, as a displacement-output unit that can obtain the displacement output corresponding to a sound signal driving the magnetostrictive actuator 103.

The base cabinet 101 includes a synthetic resin or the like. The entire base cabinet 101 is shaped like a disk. An opening 105 is provided at the center of the base cabinet 101, so as to penetrate the base cabinet 101 cylindrically. A predetermined number of leg parts 106 are provided along the perimeter of the underface of the base cabinet 101 at equal angular intervals, where the predetermined number is three in the above-described embodiment.

When the number of the leg parts 106 is determined to be three, the three leg parts 106 are always in contact with an installation surface. Therefore, the speaker device 100A can be installed with a higher stability than in the case where the number of the leg parts 106 is four. Further, since the leg parts 106 are provided on the underface of the base cabinet 101, it becomes possible to keep a distance between the underface of the base cabinet 101 and the installation surface. Further, a sound wave emitted from the speaker unit 104 fixed to the underface of the base cabinet 101 can be externally emitted.

The pipe 102 includes a predetermined material including a transparent acrylic resin or the like. The pipe 2 is fixed to the base cabinet 101. That is to say, the lower-end part of the pipe 102 is fixed to the topface of the base cabinet 101 at a predetermined number of positions by using metallic L-shaped angle steels 107, where the predetermined number is four in the above-described embodiment. The pipe 102 may be formed in a predetermined size so that the length thereof is 1000 mm, the diameter thereof is 100 mm, and the thickness thereof is 2 mm, for example.

In that case, a round hole used for screwing is formed at each of both ends of the L-shaped angle steel 107, even though the round holes are not shown. One of the ends of the L-angle steel 107 is fastened to the top face of the base cabinet 101 by using a screw 109. Screw holes (not shown) are formed in the base cabinet 101, where the screw part of the screw 109 can be screwed in each of the screw holes. In that case, a damping material 108 including a ring-shaped rubber material or the like is provided between one of the ends of the L-angle steel 107 and the topface of the base cabinet 101.

Further, the other end of the L-angle steel 107 is fastened to the lower end of the pipe 102 by using a screw 110 and a nut 111. A round hole (not shown) through which the screw part of the screw 110 passes is formed in the lower end of the pipe 102. A damping material 112 is provided between the other end of the L-angle steel 107 and the outer face of the pipe 102, and a damping material 113 is provided between the nut 111 and the inner face of the pipe 102, where each of the damping materials 112 and 113 includes a ring-shaped rubber material.

Thus, through the mediation of the damping materials 108, 112, and 113, a vibration (an elastic wave) created by the magnetostrictive actuator 103 is prevented from being propagated to the base cabinet 101 through the pipe 102 and the L-angle steel 107 so that a sound image is prevented from being localized on the base-cabinet-101 side.

A plurality of the magnetostrictive actuators 103 is provided in the base cabinet 101. According to the above-described embodiment, the number of the magnetostrictive actuators 103 is determined to be four. The four magnetostrictive actuators 103 are provided at equal intervals along the disk-like end face of the lower end of the pipe 102. The base cabinet 101 has at least one through accommodation hole 114. Each of the magnetostrictive actuators 103 is stored in the accommodation hole 114. As described above, the displacement output corresponding to a sound signal can be obtained by the drive rod 103*a*. Each of the magnetostrictive actuators 103 is arranged so that the displacement direction of the drive rod 103*a* becomes the face direction of the pipe 102, where the face direction is parallel to the pipe face of the pipe 102.

Figure 5:
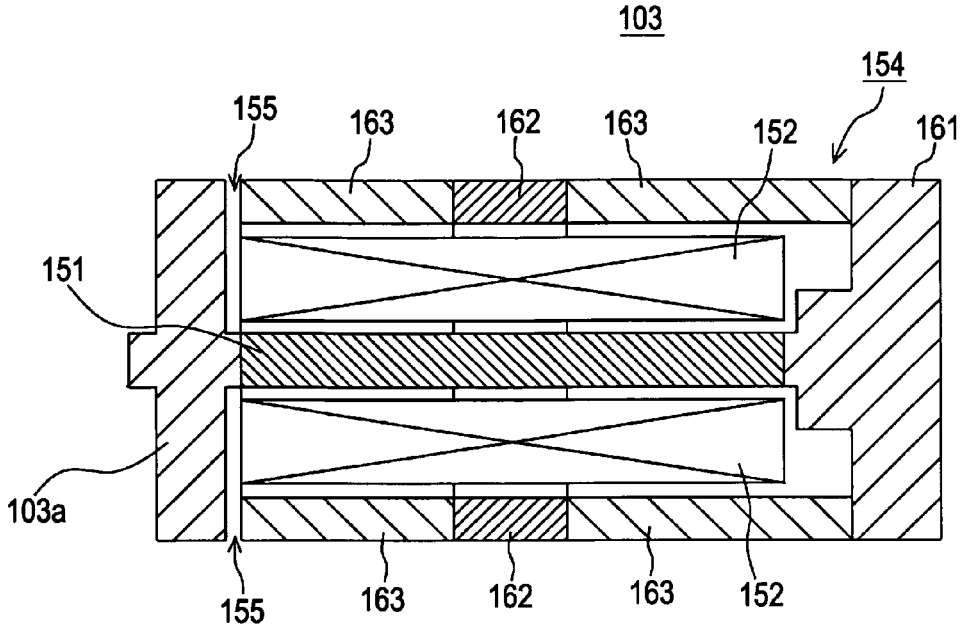
FIG. 5 is a schematic sectional view of a magnetostrictive actuator.

FIG. 5 shows an example configuration of the magnetostrictive actuator 103 including a stick-like magnetostrictive element 151 creating a displacement in the extension direction, a solenoid coil 152 provided around the magnetostrictive element 151, as magnetic-field-generation units, so as to apply a control magnetic field to the magnetostrictive element 151, the drive rod 103*a* functioning, as a movable member, the drive rod being connected to one of the ends of the magnetostrictive element 151 so that the displacement output of the magnetostrictive actuator 103 can be acquired, and an accommodation unit 154 configured to accommodate the magnetostrictive element 151 and the solenoid coil 152.

The accommodation unit 154 includes a fixed plate 161, a permanent magnet 162, and a cylindrical case 163. The fixed plate 161 is connected to the other end of the magnetostrictive element 151 so that the magnetostrictive element 151 is supported by the fixed plate 161. The permanent magnet 162, which applies a static bias magnetic field to the magnetostrictive element 151 and the cylindrical case 163, which is a structural member of a magnetic circuit, are provided around the accommodated magnetostrictive element 151. The cylindrical case 163 is attached to the drive-rod-103*a*-side and the fixed-plate-161 side of the permanent magnet 162. Since the cylindrical case 163 includes a ferromagnet, the static-bias-magnetic field can be applied to the magnetostrictive element 151 with efficiency. Further, since the fixed plate 161 also includes a ferromagnet, the static-bias-magnetic field can be applied to the magnetostrictive element 151 with higher efficiency.

A gap 155 is provided between the drive rod 103*a* and the accommodation unit 154, and the drive rod 103*a* includes a ferromagnet, so as to be attracted by the permanent magnet 162. Subsequently, a magnetic-attraction force occurs between the drive rod 103*a* and the accommodation unit 154 and a preload is imposed on the magnetostrictive element 151 attached to the drive rod 103*a* due to the magnetic-attraction force.

Figure 6:
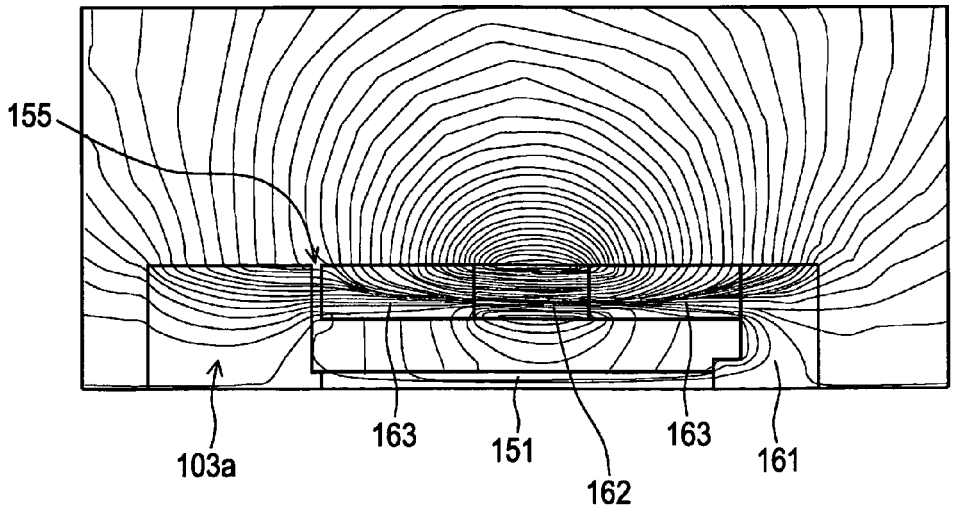
FIG. 6 shows magnetic-flux lines of the magnetostrictive actuator.

FIG. 6 shows the magnetic-flux lines of the magnetostrictive actuator 103 shown in FIG. 5. The magnetic-flux lines created by the permanent magnet 162 pass through the cylindrical case 163 and trend to the permanent magnet 162 via the gap 155, the drive rod 103*a*, and the fixed plate 161. Therefore, the magnetic-attraction force occurs between the drive rod 103*a* and the accommodation unit 154 and a preload is imposed on the magnetostrictive element 151 due to the magnetic-attraction force. Further, part of the magnetic-flux lines passes through the cylindrical case 163 and trends to the permanent magnet 162 via the gap 155, the drive rod 103*a*, the magnetostrictive element 151, and the fixed plate 161. Subsequently, the static-bias-magnetic field can be applied to the magnetostrictive element 151.

Since the drive rod 103*a* of the magnetostrictive actuator 103 shown in FIG. 5 is not supported by a bearing, there is no friction between the drive rod 103*a* and the bearing. Subsequently, the loss of the displacement output can be significantly reduced.

Further, in the magnetostrictive actuator 103, the preload is imposed on the magnetostrictive element 151 due to the magnetic-attraction force. Therefore, the preload can be repeatedly imposed with stability even though the displacement cycle of the magnetostrictive element 151 is short, and the displacement output corresponding to a control current transmitted to the solenoid coil 152 can be correctly obtained.

Therefore, in the magnetostrictive actuator 103, the relationship between the control current flowing into the solenoid coil 152 and the displacement of the drive rod 103*a* becomes increasingly linear. Subsequently, a distortion caused by the characteristic of the magnetostrictive actuator 103 is reduced, so that the load of performing feedback correction can be reduced.

Further, in the magnetostrictive actuator 103, the permanent magnet 162 is provided between the two cylindrical cases 163. Therefore, it becomes possible to make the static-bias-magnetic field applied to the magnetostrictive element 151 more smooth than in the case where the permanent magnet 162 is provided at the position of the fixed plate 161. Further, a bearing configured to support the drive rod 103*a*, a coupling member configured to connect the drive rod 103*a* to the accommodation unit 154, a spring used to impose the preload to the magnetostrictive element 151, etc. may not be provided. Therefore, the magnetostrictive actuator 103 can be reduced in size and configured at low cost.

Returning to FIGS. 1 to 4, the displacement-output-transfer member 134 is provided between the drive rod 103*a* of the magnetostrictive actuator 103 and the pipe 102. The displacement-output-transfer member 134 connects the drive rod 103*a* to an excitation point predetermined on the pipe surface of the pipe 102. In that case, a displacement output of the magnetostrictive actuator 103 is transferred to the excitation point of the pipe 102 via the displacement-output-transfer member 134. Therefore, the pipe 102 can be excited from the excitation point in the face direction according to the displacement output of the magnetostrictive actuator 103.

Figure 7:
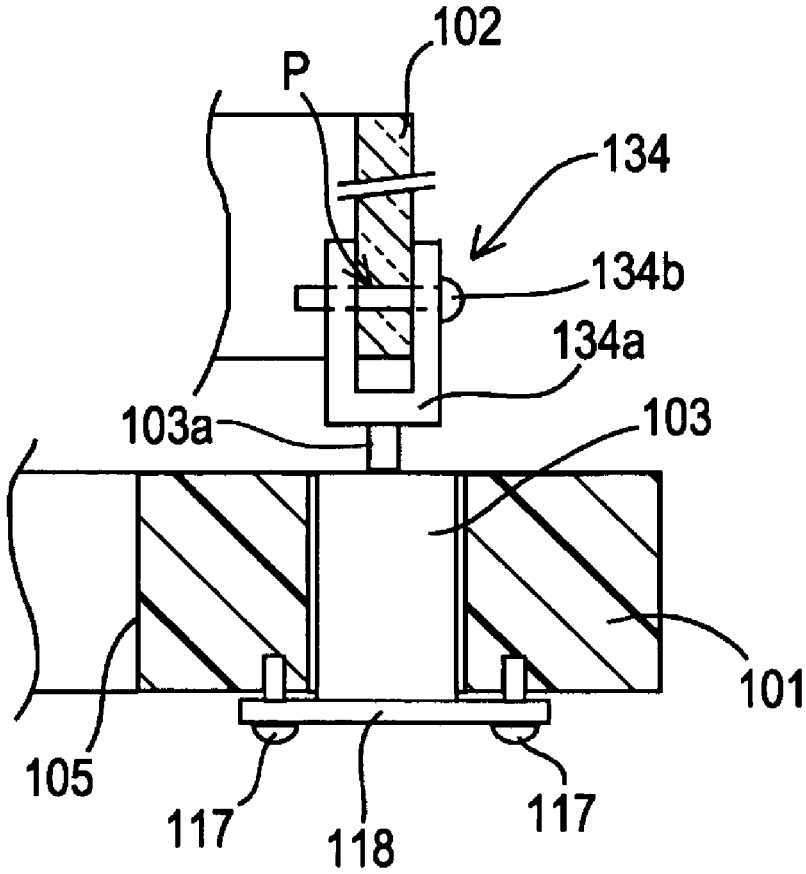
FIG. 7 shows the structure of connection between a drive rod of the magnetostrictive actuator and a pipe, where the connection is achieved by a displacement-output-transfer member.

FIG. 7 shows the structure of connection between the drive rod 103*a* of the magnetostrictive actuator 103 and the pipe 102, where the connection is achieved by the displacement-output-transfer member 134 including an approximately-U-shaped member 134*a* and a screw 134*b* provided, as a stick-like member. The approximately-U-shaped member 134*a* is connected to the drive rod 103*a* of the magnetostrictive actuator 103. In that case, the blocking-end part of the approximately-U-shaped member 134*a* is connected to the tip of the drive rod 103*a* by bonding, screwing, etc. In the case where the blocking-end part is screwed into the tip of the drive rod 103, a screw hole with a female-screw thread cut therein is provided in the blocking-end part of approximately-U-shaped member 134*a*, and a male screw thread is cut at the tip of the drive rod 103*a* so that the male screw can be screwed into the screw hole with the female-screw thread.

The approximately-U-shaped member 134*a* is connected to excitation point P of the pipe 102 by using the screw 134*b*. Namely, after inserting the end part of the pipe surface of the pipe 102 in the approximately-U-shaped member 134*a*, the screw 134*b* is screwed into the approximately-U-shaped member 134*a* and the pipe surface of the pipe 102 so that the screw 134*b* penetrates the approximately-U-shaped member 134*a* and the pipe face of the pipe 102. In that case, two screw holes are provided in the approximately-U-shaped member 134*a*. In each of the two screw holes, a female-screw thread is cut so that the screw 134*b*, which is a male screw, can be screwed into the two screw holes. Further, two penetrating holes are provided at the positions corresponding to the excitation point P specified on the pipe surface of the pipe 102 so that the screw 134*b* can be inserted into the two penetrating holes.

As described above, the magnetostrictive actuator 103 is accommodated in the through accommodation hole 114 provided in the base cabinet 101. The back-face side of the magnetostrictive actuator 103 slightly juts from the underface of the base cabinet 101, where the back-face side is the side opposite to the side where the drive rod 103*a* of the magnetostrictive actuator 103 is provided. Further, the back-face side is pressed by a leaf spring 118 fastened to the underface side of the base cabinet 101 by using screws 117.

When the back-face side of the magnetostrictive actuator 103 is pressed by the leaf spring 118 in the above-described manner, the magnetostrictive actuator 103 is energized in the direction along the face of the pipe 102 at all times. Here, parts of the pipe 102 are made contact with the screw 134*b* of the displacement-output-transfer member 134. After the pipe 102 is used over a long time period, the contact parts are worn out, so that looseness occurs between the contact parts and the screw 134*b*. In that case, however, the screw 134*b* can be pressed against the pipe 102 so that the pipe 102 can be excited appropriately in the face direction.

The leaf spring 118 fastened to the underface of the base cabinet 101 forms an energizing structure energizing the magnetostrictive actuator 103 in the direction along the face of the pipe 102. The energizing structure is not limited to the above-described structure using the leaf spring 118, but can be any structure that can energize the magnetostrictive actuator 103 in the direction along the face of the pipe 102. For example, a hole with a base may be used in place of the through accommodation hole 114, as an accommodation hole, and a compression-coil spring may be provided between the base of the accommodation hole and the back face of the magnetostrictive actuator 103 accommodated in the accommodation hole, for example.

The above-described pipe 102 and magnetostrictive actuator 103 generate a speaker handling the high-frequency side of an audio-frequency band and function, as a tweeter. On the other hand, the speaker unit 104 generates a speaker handling the low-frequency side of the audio-frequency band and functions, as a woofer.

The speaker unit 104 is fastened to the base cabinet 101 at the position corresponding to the opening 105 provided at the underface side of the base cabinet 101 by using screws (not shown), for example, where the front of the speaker unit 104 is faced downward. At that time, the direction of central axis of the speaker unit 104 agrees with the axis direction of the pipe 102. A positive-phase sound wave output from the front face of the speaker unit 104 is externally emitted from the underface side of the base cabinet 101. Further, a negative-phase sound wave output from the back face of the speaker unit 104 is externally emitted from the upper-end side of the pipe 102 via the opening 105 and the pipe 102. In that case, the pipe 102 functions, as a resonance pipe, which makes it possible to perform massive low-frequency reproduction.

Here, a damping material 116 including a ring-shaped rubber material or the like is provided between the lower end of the pipe 102 and the base cabinet 101 so that a vibration created by the magnetostrictive actuator 103 is prevented from being propagated to the base cabinet 101 through the pipe 102. Further, the airtightness can be increased so that the pipe 102 appropriately functions, as the resonance pipe.

Figure 8:
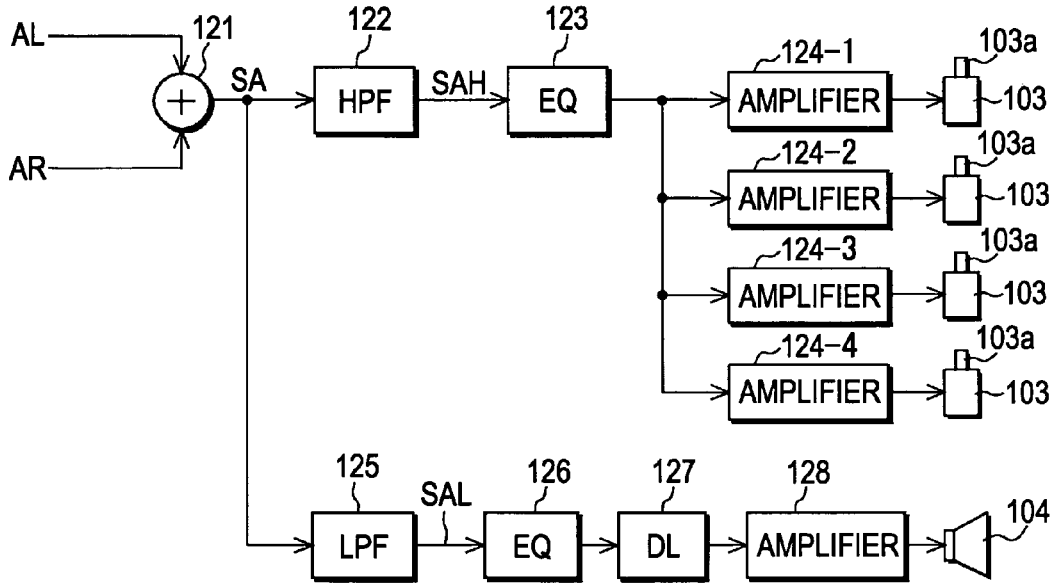
FIG. 8 is a block diagram showing a configuration of a system driving the magnetostrictive actuators and a speaker unit.

FIG. 8 shows the configuration of a system driving four magnetostrictive actuators 103 and the speaker unit 104.

Each of a left-sound signal AL and a right-sound signal AR that are included in a stereo-sound signal is transmitted to an adder 121, and the sound signals AL and AR are combined with each other in the adder 121 so that a monaural-sound signal SA is generated. A high-frequency component SAH is extracted from the monaural-sound signal SA in a high-pass filter 122. The high-frequency component SAH is subjected to the frequency-characteristic correction corresponding to the magnetostrictive actuator 103 by an equalizer 123, amplified by amplifiers 124-1, 124-2, 124-3, and 124-4, and transmitted to each of the four magnetostrictive actuators 103, as a drive signal. Subsequently, the four magnetostrictive actuators 103 are driven by the same high-frequency component SAH and each of the drive rods 103*a* is displaced according to the high-frequency component SAH.

Further, a low-frequency component SAL is extracted from the monaural-sound signal SA generated by the adder 121 by a low-pass filter 125. The low-frequency component SAL is subjected to the frequency-characteristic correction corresponding to the resonance pipe including the pipe 102 by an equalizer 126. After that, the low-frequency component SAL is delayed by a delay circuit 127 having a delay time of several milliseconds, amplified by an amplifier 128, and transmitted to the speaker unit 104, as a drive signal. Subsequently, the speaker unit 104 is driven by the low-frequency component SAL.

The delay circuit 127 is inserted into a path through which the low-frequency component SAL is transmitted to the speaker unit 104, so that the time where a low-frequency sound wave is emitted from the speaker unit 104 is later than the time where a high-frequency sound wave is emitted from the pipe 102. Subsequently, according to the auditory characteristic of a person that a sound image is attracted to a high-frequency region, an audience tends to feel a sound image at the part corresponding to the pipe 102 from which the high-frequency sound wave is emitted.

Operations of the speaker device 100A shown in FIGS. 1 to 4 will be described.

Each of the four magnetostrictive actuators 103 accommodated and fixed to the base cabinet 101 is driven by the high-frequency component SAH of the monaural-sound signal SA, and the drive rod 103*a* of each of the four magnetostrictive actuators 103 is displaced according to the high-frequency component SAH. The displacement of the drive rod 103*a* (a displacement output of the actuator 103) is transferred to the excitation point P (refer to FIG. 7) specified on the surface of the pipe 102 via the displacement-output-transfer member 134. Therefore, the pipe 102 is excited from the excitation point P in the face direction according to the displacement output of the actuator 103.

In that case, the excitation point P specified on the pipe 102 is excited by a longitudinal wave so that an elastic wave (vibration) is propagated in the face direction. Then, when the elastic wave is propagated through the pipe 102, the mode is changed repeatedly so that longitudinal waves and transverse waves are generated alternately. Subsequently, a mixed wave including the longitudinal wave and the transverse wave is generated, and a vibration in the in-face direction (direction vertical to the face) of the pipe 102 is excited by the transverse wave, so that a sound wave is emitted from the pipe 102. Namely, the high-frequency-sound output corresponding to the high-frequency component SAH can be obtained from the outer face of the pipe 102.

In that case, since each of the four magnetostrictive actuators 103 provided at equal intervals along the disk-like end face of the lower end of the pipe 102 is driven by the same high-frequency component SAH, nondirectional high-frequency-sound outputs can be obtained from the perimeter of the pipe 102.

Further, the speaker unit 104 fixed to the underface side of the base cabinet 101 is driven by the low-frequency component SAL of the monaural-sound signal SA. A low-frequency-sound output (positive phase) can be obtained from the front of the speaker unit 104, and the obtained sound output is externally emitted from the underface side of the base cabinet 101. Further, another low-frequency-sound output (negative phase) can be obtained from the back of the speaker unit 104, and externally emitted from the upper-end side of the pipe 102 via the opening 105 and the pipe 102.

According to the speaker device 100A shown in FIGS. 1 to 4, the magnetostrictive actuator 103 driven by the high-frequency component SAH of the monaural-sound signal SA excites the pipe 102 from the excitation point P in the face direction. Therefore, no large transverse wave occurs at the excitation point P so that a sound wave emitted from the excitation point P is not heard, as a sound significantly louder than a sound wave emitted from another position. Therefore, it becomes possible to localize a sound image over the entire pipe 102 in the longitudinal direction, and a sound image with the spaciousness feeling can be obtained.

Further, according to the speaker device 100A shown in FIGS. 1 to 4, the displacement output of the magnetostrictive actuator 103 is transferred to the excitation point P determined on the pipe surface of the pipe 102 via the displacement-output-transfer member 134. Therefore, the displacement output of the magnetostrictive actuator 103 can be transferred to the pipe 102 more correctly than in the case where the drive rod 103*a* of the magnetostrictive actuator 103 simply abuts the end face of the pipe 102, and a sound output faithful to a sound signal can be obtained from the pipe 102.

Figure 9:
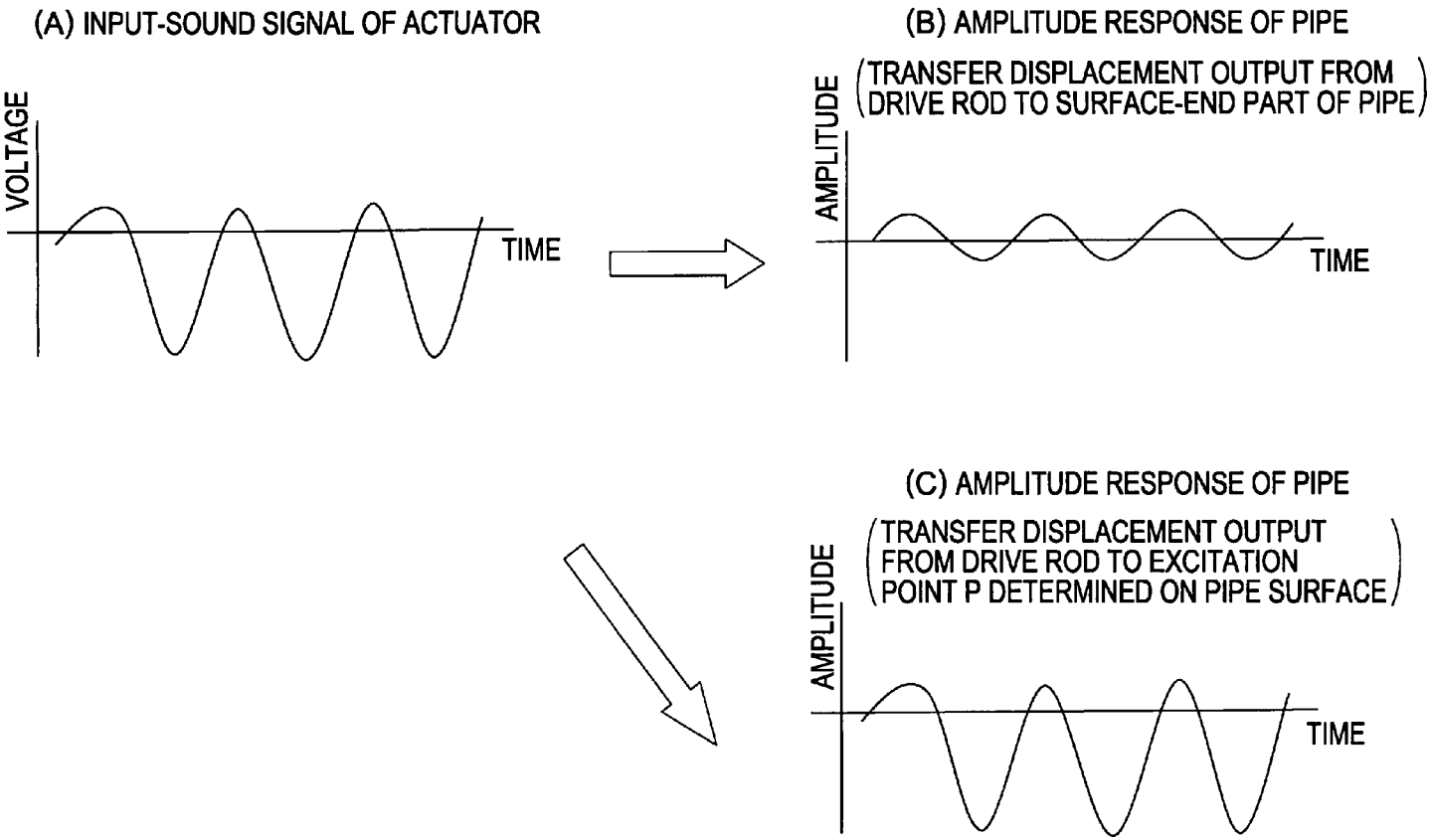
FIG. 9 shows the correspondence between a sound signal transmitted to the magnetostrictive actuator and an amplitude response of a pipe to which a displacement output of the magnetostrictive actuator is transferred.

For example, an example where a sound signal shown in part (A) of FIG. 9 is input to the magnetostrictive actuator 103 will be described. In that case, when a displacement output of the magnetostrictive actuator 103 is transferred to the excitation point P determined on the pipe surface of the pipe 102 via the displacement-output-transfer member 134, as in the case where the speaker device 100A shown in FIGS. 1 to 4 is used, the excitation operation of the pipe 102 appropriately follows each of an upward displacement operation and a downward displacement operation that are performed by the drive rod 103*a*. Therefore, an amplitude response in the face direction of the pipe 102 becomes, as shown in part (C) of FIG. 9, which makes it possible to obtain a sound output faithful to a sound signal from the pipe 102.

On the other hand, in the case where the drive rod 103*a* of the magnetostrictive actuator 103 simply abuts the end face of the pipe 102, the excitation operation of the pipe 102 does not follow the downward displacement operation of the drive rod 103*a* even though the excitation operation of the pipe 102 appropriately follows the upward displacement operation of the drive rod 103*a*. Therefore, the amplitude response in the face direction of the pipe 102 becomes, as shown in part (B) of FIG. 9, which makes it difficult to obtain the sound output faithful to a sound signal from the pipe 102.

Further, according to the speaker device 100A shown in FIGS. 1 to 4, the displacement-output-transfer member 134 includes the approximately-U-shaped member 134*a* connected to the drive rod 103*a* of the magnetostrictive actuator 103 and the screw 134*b*. When the end part of the pipe 102 is inserted into the approximately-U-shaped member 134*a*, the screw 134*b* penetrates the approximately-U-shaped member 134*a* and the pipe surface of the pipe 102 so that the approximately-U-shaped member 134*a* and the pipe 102 are connected to each other. Subsequently, the use of the approximately-U-shaped member 134*a* allows for transferring the displacement output of the magnetostrictive actuator 103 to the excitation point P determined on the pipe surface of the pipe 102 from both sides of the pipe surface of the pipe 102, so that the displacement output of the magnetostrictive actuator 103 can be transferred to the excitation point P with stability.

Further, according to the speaker device 100A shown in FIGS. 1 to 4, the displacement-output-transfer member 134 includes the approximately-u-shaped member 134*a*. However, the member 134*a* may not be approximately U-shaped so long as appropriate vibrations can be transferred to the pipe 102 in upward and downward directions from the excitation point P determined to be the fulcrum. For example, one of the sides of the approximately-U-shaped member 134*a* may be removed so that an L-shaped member is formed, for example, as the displacement-output-transfer member 134.

Further, according to the speaker device 100A shown in FIGS. 1 to 4, the displacement-output-transfer member 134 includes the approximately-U-shaped member 134*a* and the screw 134*b* so that the approximately-U-shaped member 134*a* is connected to the pipe (diaphragm) 102 by using the screw 134*b*. Subsequently, the pipe 102 can be easily mounted and/or dismounted on and/or from the speaker device 100A.

Further, according to the above-described configurations, the system driving the four magnetostrictive actuators 103 and the speaker unit 104 is configured, as shown in FIG. 8, and each of the four magnetostrictive actuators 103 is driven by the same high-frequency component SAH. However, the four magnetostrictive actuators 103 may be driven by high-frequency components SAH independent of one another.

Figure 10:
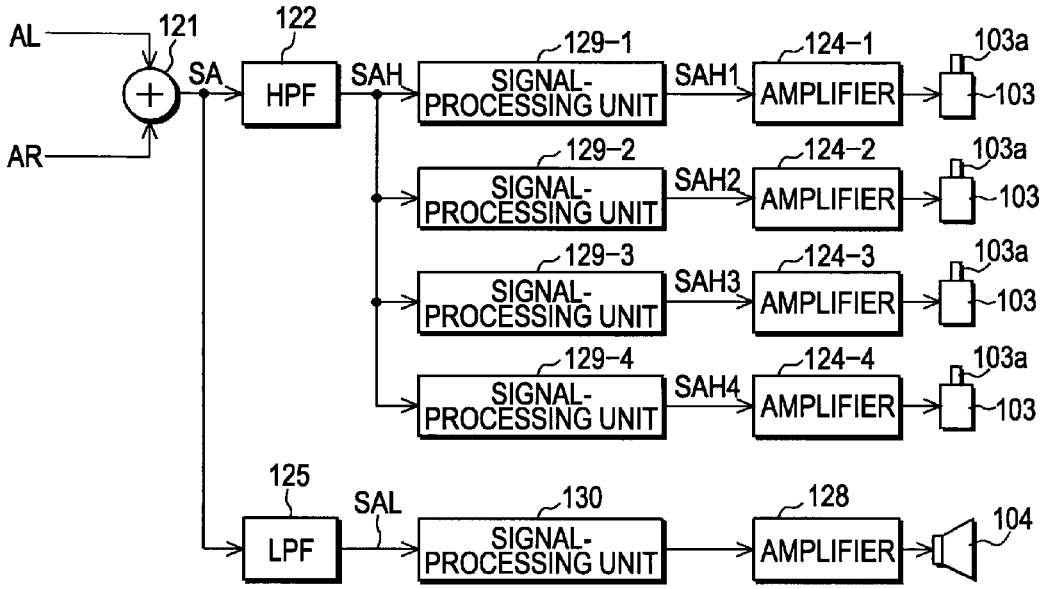
FIG. 10 is a block diagram showing another configuration of the system driving the magnetostrictive actuators and the speaker unit.

FIG. 10 shows another configuration of the system driving the four magnetostrictive actuators 103 and the speaker unit 104. In FIG. 10, the same parts as those shown in FIG. 8 are designated by the same reference numerals and the descriptions thereof are omitted.

A high-frequency component SAH extracted by the high-pass filter 122 is transmitted to each of four signal-processing units 129-1, 129-2, 129-3, and 129-4. Each of the signal-processing units 129-1 to 129-4 independently adjusts the level, delay time, frequency characteristic, etc. of the high-frequency component SAH (sound-field-control processing). Further, each of the signal-processing units 129-1 to 129-4 performs signal-correction processing relating to the output characteristic of the magnetostrictive actuator 103. High-frequency components SAH1, SAH2, SAH3, and SAH4 transmitted from the above-described signal-processing units 129-1 to 129-4 are amplified by the amplifiers 124-1 to 124-4, respectively, and transmitted to the four magnetostrictive actuators 103, as drive signals. Subsequently, the four magnetostrictive actuators 103 are driven by the high-frequency components SAH1 to SAH4 independent of one another, and the drive rods 103*a* are displaced according to the high-frequency components SAH1 to SAH4, respectively.

Further, the low-frequency component SAL extracted by the low-pass filter 125 is transmitted to the signal-processing unit 130. The signal-processing unit 130 adjusts the level, delay time, frequency characteristic, etc. of the low-frequency component SAL (sound-field-control processing), and signal-correction processing relating to the resonance-pipe characteristic. The low-frequency component output from the signal-processing unit 130 is amplified by the amplifier 128, and transmitted to the speaker unit 104, as a drive signal. Subsequently, the speaker unit 104 is driven by the low-frequency component.

According to the configuration of the driving system shown in FIG. 10, the four magnetostrictive actuators 103 are driven by the high-frequency components SAH1 to SAH4 that are independently processed by the signal processing units 129-1 to 129-4, so that a sound with a feeling of increased spaciousness can be obtained. Further, in FIG. 10, each of the high-frequency components SAH1 to SAH4 driving the four magnetostrictive actuators 103 is obtained from the monaural-sound signal SA. However, each of the high-frequency components SAH1 to SAH4 can be obtained from the left-sound signal AL and the right-sound signal AR included in the stereo-sound signal and/or a multi-channel sound signal.

Figure 11:
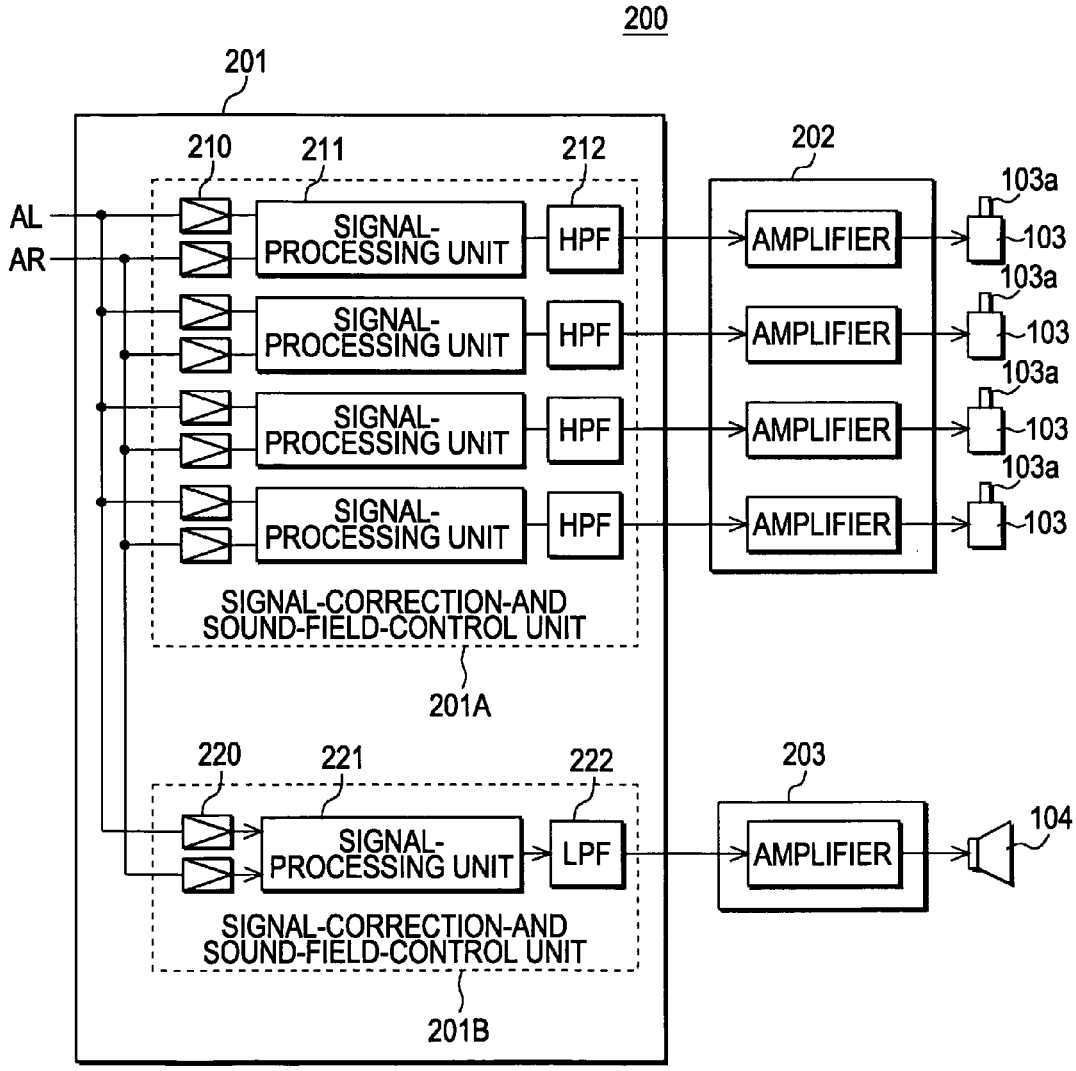
FIG. 11 is a block diagram showing another configuration of the system driving the magnetostrictive actuators and the speaker unit.

FIG. 11 shows another example system driving the four magnetostrictive actuators 103 and the speaker unit 104.

The driving system 200 includes a digital-signal-processor (DSP) block 201 and amplifier blocks 202 and 203. The DSP block 201 includes a unit 201A provided to perform signal correction and sound-field control for the magnetostrictive actuators 103, and a unit 201B provided to perform signal correction and sound-field control for the speaker unit 104.

The signal-correction-and-sound-field-control unit 201A provided on the magnetostrictive-actuator side includes four signal-processing units 211 and four high-pass filters (HPF) 212, so as to be ready for the four magnetostrictive actuators 103. The signal-correction-and-sound-field-control unit 201A further includes eight attenuators 210, so as to attenuate and transmit the left-sound signal AL and the right-sound signal AR that are included in the stereo-sound signal to the four signal-processing units 211.

Each of the signal-processing units 211 adjusts the level, delay time, frequency characteristic, etc. of each of the transmitted sound signals AL and AR, and mixes the sound signals AL and AR with each other (sound-field-control processing). Further, each of the signal-processing units 211 performs signal-correction processing related to the output characteristic of the magnetostrictive actuator 103. Each of the high-pass filters 212 extracts a high-frequency component from a sound signal transmitted from the signal-processing unit 211 corresponding to the high-pass filter 212, and transmits the high-frequency component to the amplifier block 202.

In that case, the high-frequency components of the sound signals independently subjected to the sound-field-control processing and the signal-correction processing by the signal-correction-and-sound-field-control unit 201A of the DSP block 201 are amplified by the amplifier block 202 and transmitted to the magnetostrictive actuators 103, respectively. Thus, each of the four magnetostrictive actuators 103 is driven by the high-frequency component of the sound signal subjected to the sound-field-control processing so that the spaciousness feeling of the sound can be increased due to a high-frequency-sound output.

On the other hand, the signal-correction-and-sound-field-control unit 201B provided on the speaker-unit side includes a single signal-processing unit 221 and a single low-pass filter (LPF) 222, so as to be ready for the speaker unit 104. The signal-correction-and-sound-field-control unit 201B further includes two attenuators 220, so as to attenuate and transmit the left-sound signal AL and the right-sound signal AR that are included in the stereo-sound signal to the signal-processing unit 211.

The signal-processing unit 221 adjusts the level, delay time, frequency characteristic, etc. of each of the transmitted sound signals AL and AR, and mixes the sound signals AL and AR with each other (sound-field-control processing). Further, the signal-processing unit 221 performs signal-correction processing related to the resonance-pipe characteristic. The low-pass filter 222 extracts a low-frequency component from the sound signal transmitted from the signal-processing unit 221, and transmits the extracted low-frequency component to the amplifier block 203.

In that case, the low-frequency component of the sound signal subjected to the sound-field-control processing and the signal-correction processing by the signal-correction-and-sound-field-control unit 201B of the DSP block 201 is amplified by the amplifier block 203 and transmitted to the speaker unit 104. The speaker unit 104 is driven by the low-frequency component of the sound signal subjected to the sound-field-control processing so that the spaciousness feeling of the sound can be increased due to a low-frequency-sound output.

Figure 17:
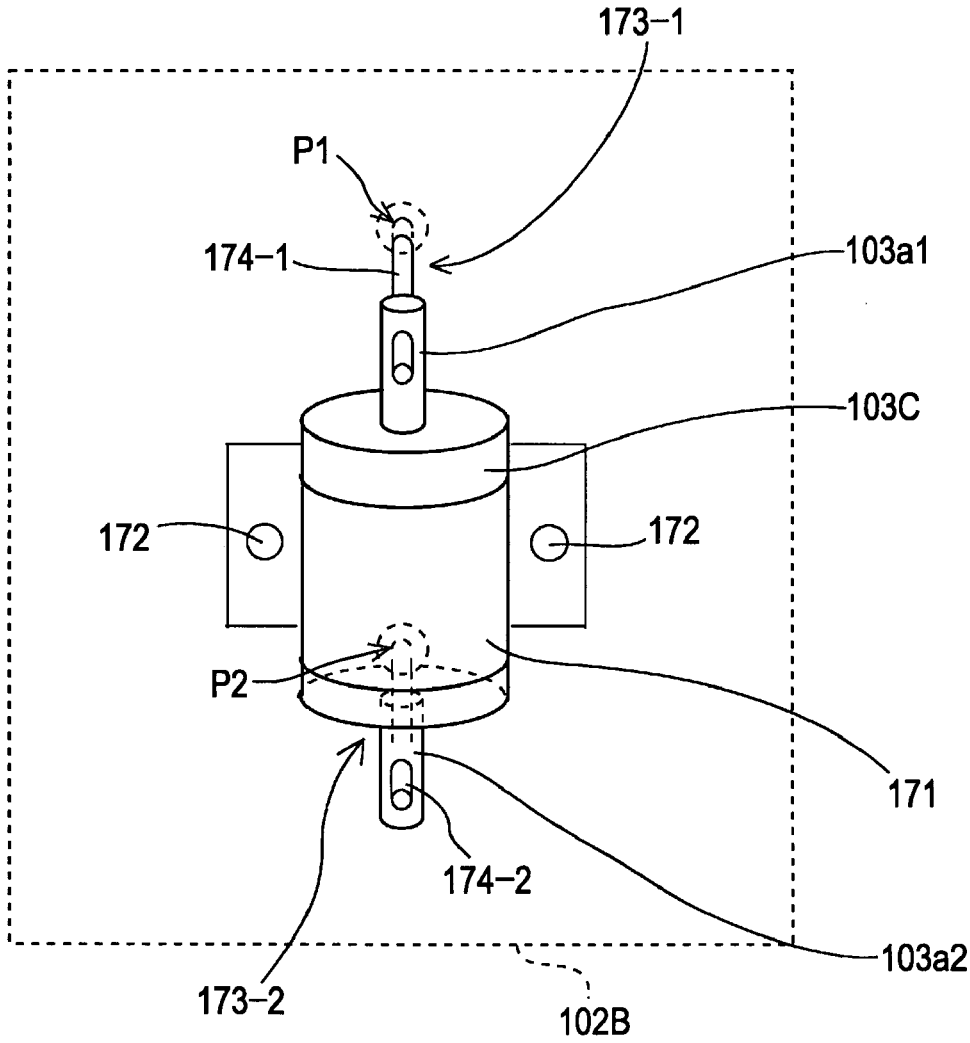
FIG. 17 is an enlarged view of a part where a magnetostrictive actuator is fixed.

Here, in the driving system 200 shown in FIG. 17, the order in which the signal-processing units 211 and the high-pass filters 212 are provided in the signal-correction-and-sound-field-control unit 201A may be reversed. Likewise, the order in which the signal-processing unit 221 and the low-pass filter 222 are provided in the signal-correction-and-sound-field-control unit 201B may be reversed.

Figure 12:
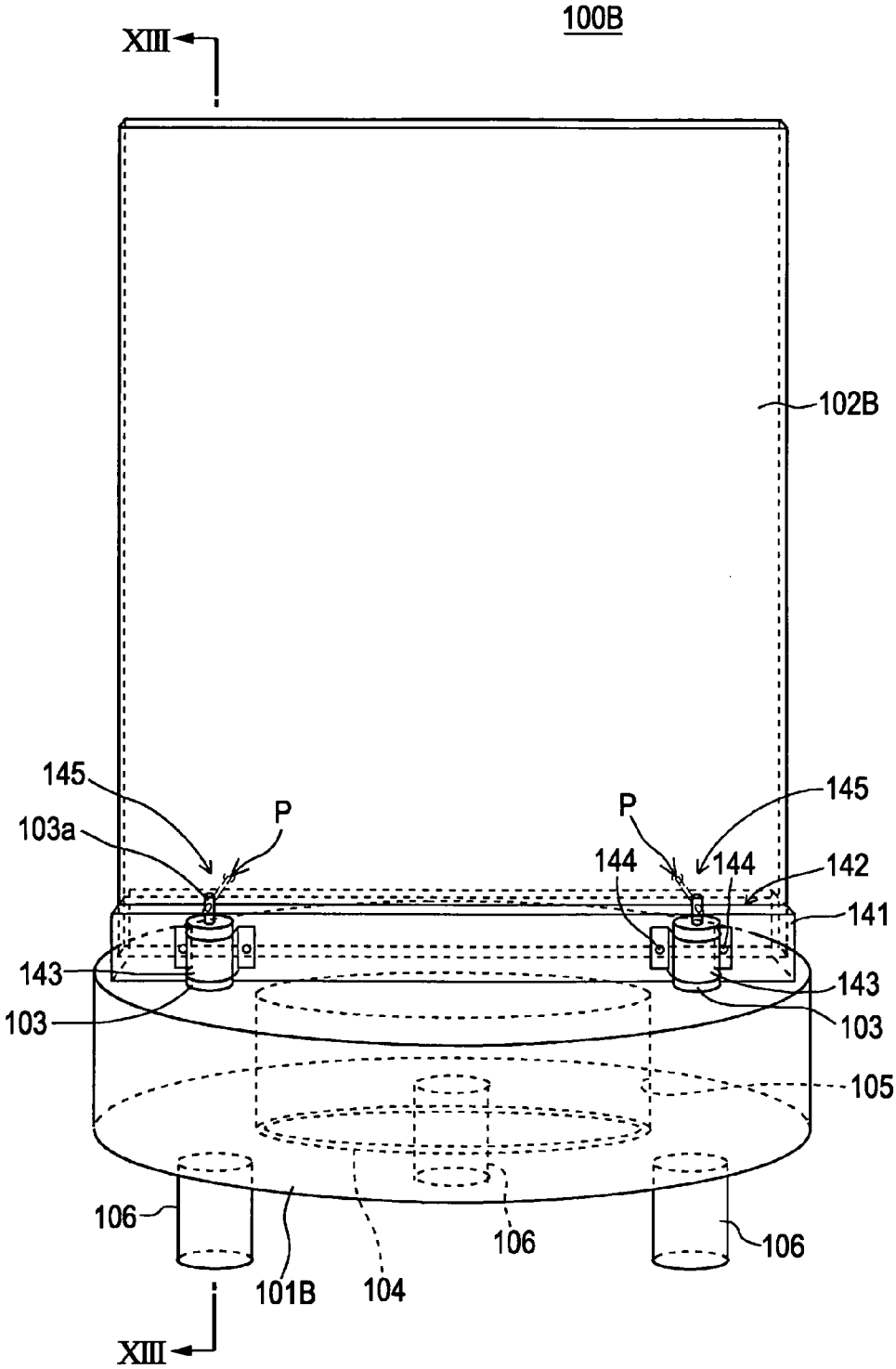
FIG. 12 is a perspective view of a speaker device according to another embodiment of the present invention.
Figure 13:
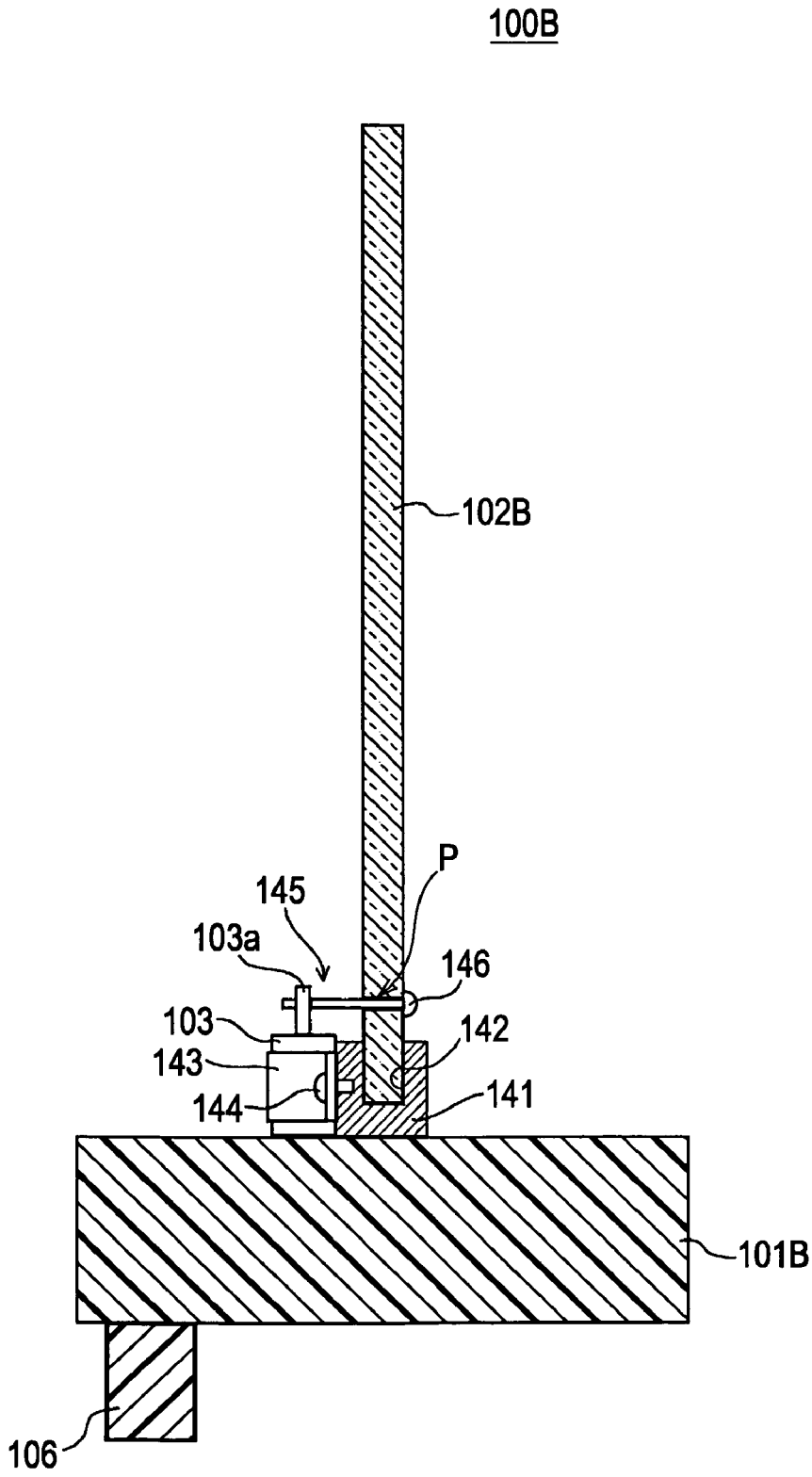
FIG. 13 is a longitudinal-sectional view of the speaker device shown in FIG. 12.
Figure 14:
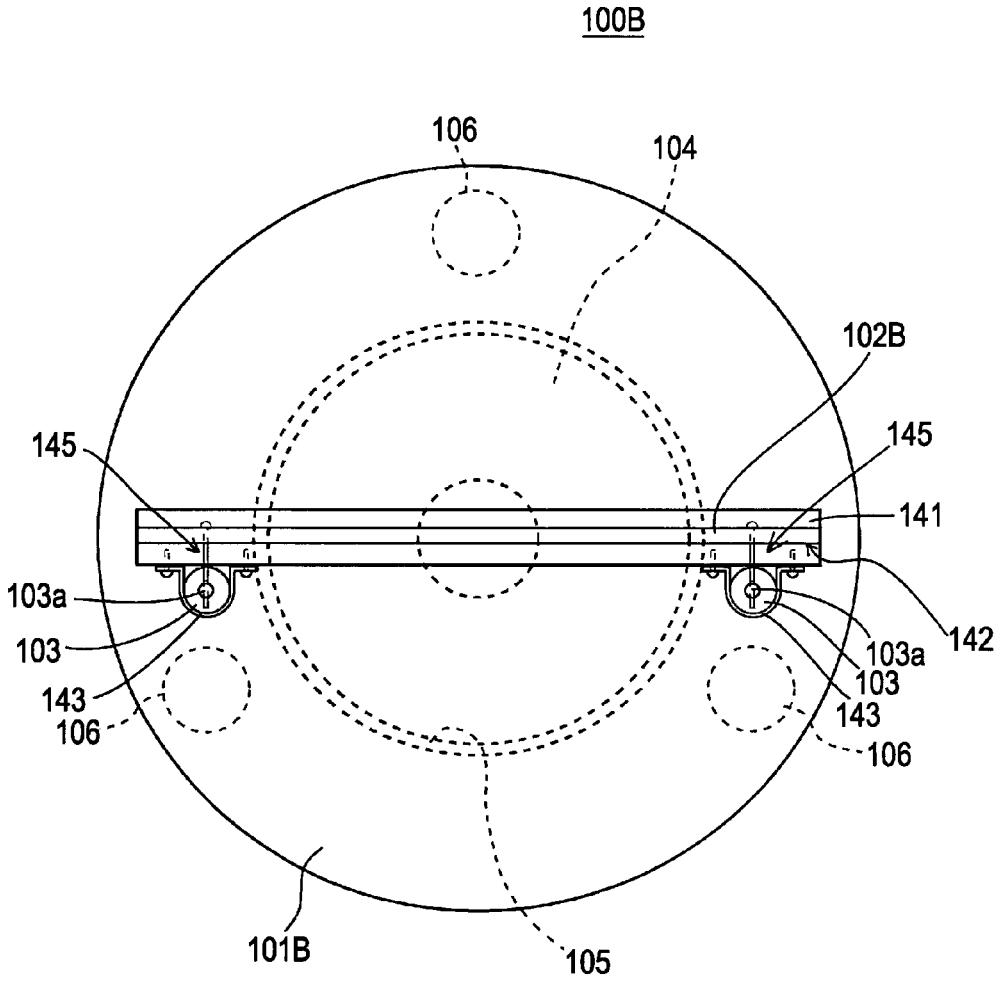
FIG. 14 is a topface view of the speaker device shown in FIG. 12.

Next, a speaker device 100B according to another embodiment of the present invention will be described. Each of FIGS. 12, 13, and 14 shows the configuration of the speaker device 100B. FIG. 12 is a perspective view of the speaker device 100B, and FIG. 13 is a longitudinal-sectional view of the speaker device 100A, where the speaker device 100A is cut along the line XIII-XIII shown in FIG. 12. FIG. 14 shows the topface view of the speaker device 100B. In each of FIGS. 12 to 14, the parts corresponding to those shown in FIGS. 1 to 4 are designated by the same reference numerals and the descriptions thereof are omitted.

In the above-described speaker device 100A shown in FIGS. 1 to 4, the pipe 102, which is a cylindrical diaphragm, is used, as an acoustic diaphragm. In the speaker device 100B, however, a rectangular acrylic plate 102B, which is a flat-shaped diaphragm, is used, as the acoustic diaphragm.

The acrylic plate 102B is perpendicularly fixed to the base cabinet 101B via a rectangular-parallelepiped-shaped cabinet-fixing plate 141. In that case, the cabinet-fixing plate 141 is fixed to the topface side of the base cabinet 101B by using an adhesive or the like. Further, a groove 142 of a cross-sectional rectangular shape is provided along a longitudinal direction on the topface side of the cabinet-fixing plate 141, as shown in FIG. 13. The lower end of the acrylic plate 102B is press-fitted into the groove 142. Otherwise, after being press-fitted into the groove 142, the lower end of the acrylic plate 102B is adhered to the groove 142, for example. Thus, the acrylic plate 102B is fixed to the cabinet-fixing plate 141.

A plurality of the magnetostrictive actuators 103 (two magnetostrictive actuators 103 according to the above-described embodiment) are fixed to the cabinet-fixing plate 141 so that the direction in which the drive rod 103*a* is displaced agrees with the direction along the face of the acrylic plate 102B (vertical direction in the above-described embodiment). In that case, each of the magnetostrictive actuators 103 is fixed to the cabinet-fixing plate 141 by using a fixture 143 of a shape which agrees with the outer shape of the magnetostrictive actuator 103, where the fixture 143 is fastened to the side face of the cabinet-fixing plate 141 by using screws 144.

A displacement-output-transfer member 145 is provided between the drive rod 103*a* of the magnetostrictive actuator 103 and the acrylic plate 102B. The displacement-output-transfer member 145 connects the drive rod 103*a* to excitation point P predetermined on the face of the acrylic plate 102B. In that case, the displacement output of the magnetostrictive actuator 103 is transferred to the excitation point P specified on the acrylic plate 102B via the displacement-output-transfer member 145. Therefore, it becomes possible to excite the acrylic plate 102B from the excitation point P in the face direction according to the displacement output of the actuator 103.

In the above-described embodiment, the displacement-output-transfer member 145 includes a screw 146, as shown in FIG. 13. The screw 146 connects the drive rod 103*a* to the excitation point P specified on the acrylic plate 102B. Namely, the screw 146, which is a stick-like member, penetrates the drive rod 103*a* and the acrylic plate 102B so that the drive rod 103*a* and the acrylic plate 102B are fastened to each other. In that case, a penetration hole where the screw part of the screw 146 passes through is provided at the position corresponding to the excitation point P specified on the acrylic plate 102B, and a screw hole with a female-screw thread cut therein is provided in the drive rod 103*a*.

For example, each of the magnetostrictive actuators 103 is driven by the same high-frequency component by the above-described driving system shown in FIG. 8, and each of the drive rods 103*a* is displaced according to the high-frequency component. Otherwise, the above-described two magnetostrictive actuators 103 are driven by the high-frequency components SAH1 and SAH2 that are independent of each other by the above-described driving systems shown in FIGS. 10 and 11, for example. Further, the drive rods 103*a* of the magnetostrictive actuators 103 are displaced according to the high-frequency components SAH1 and SAH2.

Since the acoustic diaphragm of the speaker device 100B is the rectangular acrylic plate 102B, which is the flat-shaped diaphragm, it is difficult to use the acoustic diaphragm, as a resonance pipe. Therefore, the topface side of the opening 105 of the base cabinet 101B is closed, and an enclosed space is formed on the back-face side of the speaker unit 104, as a back cavity, so that bass can be generated appropriately.

Operations of the speaker device 100B shown in FIGS. 12, 13, and 14 will be described.

The two magnetostrictive actuators 103 fixed to the cabinet-fixing plate 141 are driven by the high-frequency component SAH of the monaural-sound signal SA, and the drive rods 103*a* of the magnetostrictive actuators 103 are displaced according to the high-frequency component SAH. The displacement of each of the drive rods 103*a* (a displacement output of the actuator 103) is transferred to the excitation point P specified on the acrylic plate 102P via the displacement-output-transfer member 145. Therefore, the acrylic plate 102B is excited from the excitation point P in the face direction according to the displacement output of the actuator 103.

In that case, the excitation point P specified on the acrylic plate 102B is excited by a longitudinal wave so that an elastic wave (vibration) is propagated through acrylic plate 102B in the face direction. Then, when the elastic wave is propagated through the acrylic plate 102B, the mode is changed repeatedly so that longitudinal waves and transverse waves are generated alternately. Subsequently, a mixed wave including the longitudinal wave and the transverse wave is generated, and a vibration in the in-face direction (direction vertical to the face) of the acrylic plate 102B is excited by the transverse wave so that a sound wave is emitted from each of one and the other faces of the acrylic plate 102B. Namely, the high-frequency-sound output corresponding to the high-frequency component SAH can be obtained from the outer face of the acrylic plate 102B.

Further, the speaker unit 104 fixed to the underface side of the base cabinet 101 is driven by the low-frequency component SAL of the monaural-sound signal SA. Then, a low-frequency-sound output (positive phase) can be obtained from the front of the speaker unit 104, and the obtained sound output is externally emitted from the underface side of the base cabinet 101B.

According to the speaker device 100B shown in FIGS. 12 to 14, the magnetostrictive actuator 103 driven by the high-frequency component SAH of the monaural-sound signal SA, for example, excites the acrylic plate 102B from the excitation point P in the face direction, as is the case with the speaker device 100A shown in FIGS. 1 to 4. Therefore, no large transverse wave occurs at the excitation point P so that a sound wave emitted from the excitation point P is not heard, as a sound significantly louder than a sound wave emitted from another position. Therefore, it becomes possible to localize a sound image over the entire face of the acrylic plate 102B, and a sound image with the spaciousness feeling can be obtained.

Further, according to the speaker device 100B shown in FIGS. 12 to 14, the displacement output of the magnetostrictive actuator 103 is transferred to the excitation point P determined on the face of the acrylic plate 102B via the displacement-output-transfer member 145. Therefore, the displacement output of the magnetostrictive actuator 103 can be transferred to the acrylic plate 102B more correctly than in the case where the drive rod 103*a* of the magnetostrictive actuator 103 simply abuts the end face of the acrylic plate 102B, for example, and a sound output faithful to a sound signal can be obtained from the acrylic plate 102B.

Further, according to the speaker device 100B shown in FIGS. 12 to 14, the displacement-output-transfer member 145 includes the screw 146 connecting the drive rod 103*a* to the acrylic plate 102B. Namely, the screw 146 penetrates the drive rod 103*a* and the acrylic plate 102B so that the drive rod 103*a* and the acrylic plate 102B are connected to each other. Therefore, even though the cabinet-fixing plate 141 is provided on the lower-end side of the acrylic plate 102B, the magnetostrictive actuator 103 can be provided on one of the faces of the acrylic plate 102B, and the displacement output of the magnetostrictive actuator 103 can be appropriately transferred to the acrylic plate 102B.

Figure 15:
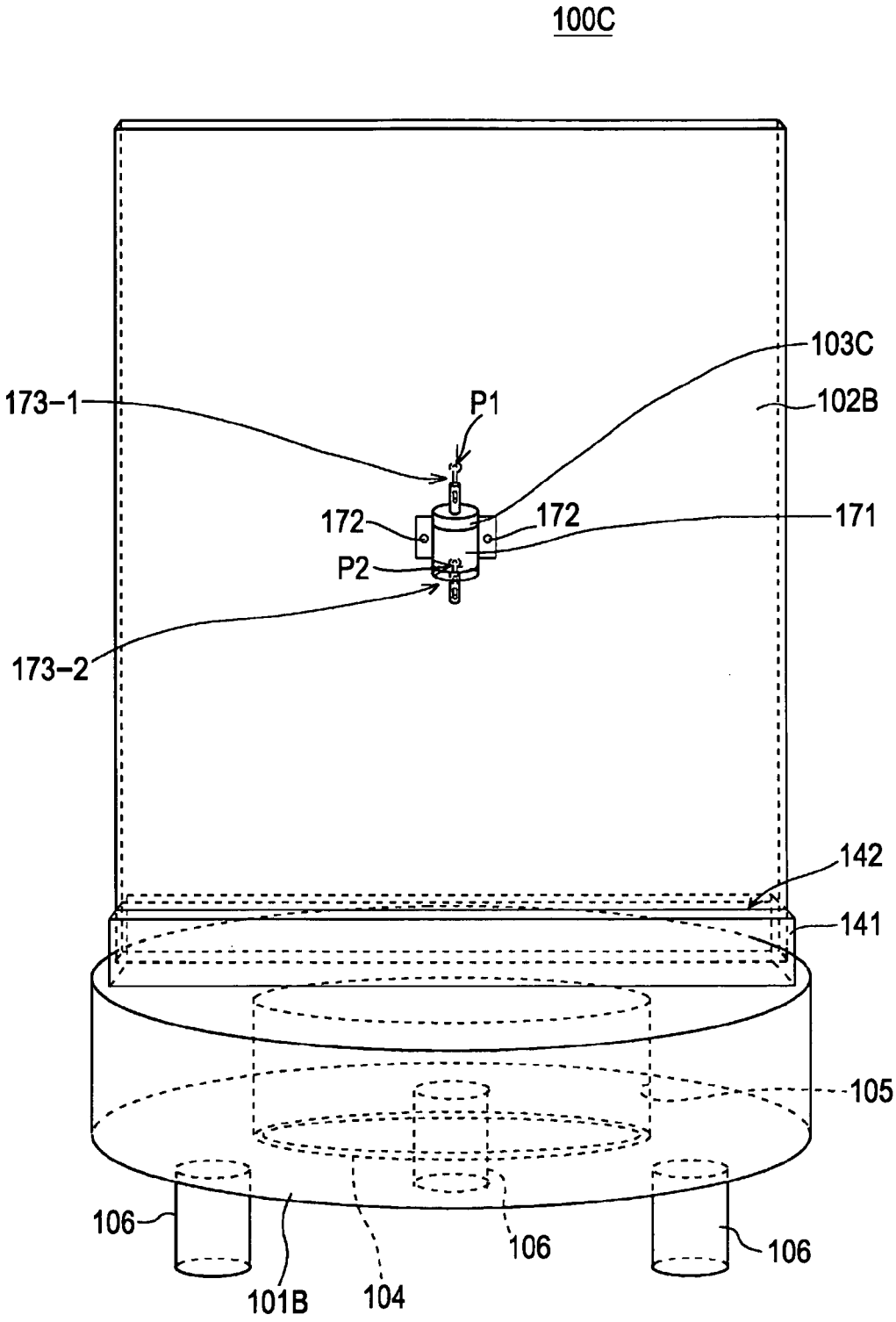
FIG. 15 is a perspective view of a speaker device according to another embodiment of the present invention.
Figure 16:
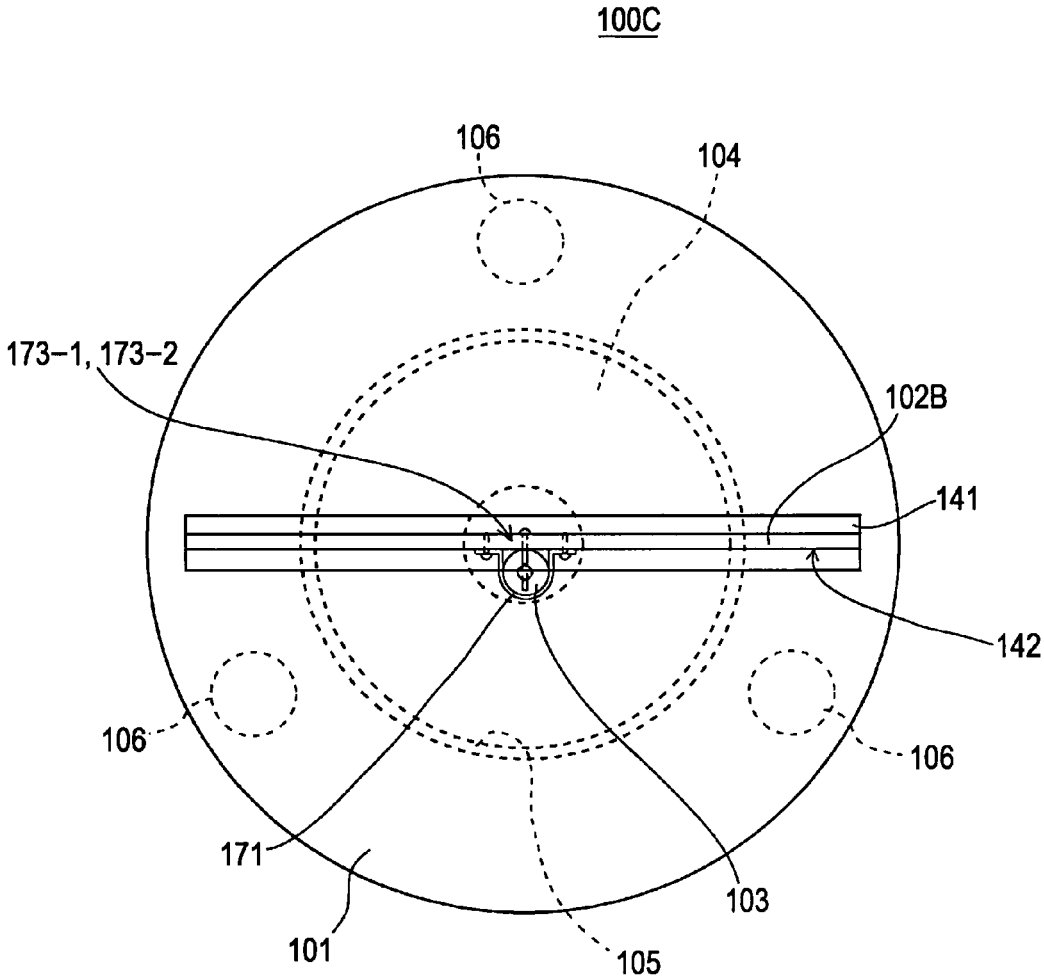
FIG. 16 is a topface view of the speaker device shown in FIG. 15.

Next, each of FIGS. 15 and 16 shows the configuration of a speaker device 100C according to another embodiment of the present invention. FIG. 15 is a perspective view of the speaker device 100C, and FIG. 16 is a topface view of the speaker device 100C. In each of FIGS. 15 and 16, the parts corresponding to those shown in FIGS. 12 to 14 are designated by the same reference numerals and the descriptions thereof are omitted.

In the speaker device 100C, a magnetostrictive actuator 103C is used in place of the magnetostrictive actuator 103. As described above, the drive rod 103*a* used to obtain a displacement output is provided only on one of the ends of the magnetostrictive actuator 103. However, a drive rod 103*a*1 is provided on one of the ends of the magnetostrictive actuator 103C and a drive rod 103*a*2 is provided on the other end of the magnetostrictive actuator 103C, as shown in FIG. 17, where the drive rods 103*a*1 and 103*a*2 are displaced, so as to be mutually axisymmetrical.

A predetermined number of and/or at least one magnetostrictive actuator 103 (a single magnetostrictive actuator 103 according to the above-described embodiment) is fixed to the acrylic plate 102B so that the direction in which each of the drive rods 103*a*1 and 103*a*2 is displaced agrees with the direction along the face of the acrylic plate 102B (perpendicular direction in the above-described embodiment). In that case, the magnetostrictive actuator 103 is fixed to the acrylic plate 102B by using a fixture 171 of a shape which agrees with the outer shape of the magnetostrictive actuator 103C, where the fixture 171 is fastened to the acrylic plate 102B by using screws 172.

A displacement-output-transfer member 173-1 is provided between the drive rod 103*a*1 of the magnetostrictive actuator 103C and the acrylic plate 102B. The displacement-output-transfer member 173-1 connects the drive rod 103*a*1 to excitation point P1 which is the first point specified on the face of the acrylic plate 102B. In that case, the displacement output of the magnetostrictive actuator 103C is transferred to the excitation point P1 specified on the acrylic plate 102B via the displacement-output-transfer member 173-1. Therefore, it becomes possible to excite the acrylic plate 102B from the excitation point P1 in the face direction according to the displacement output of the actuator 103C.

In the above-described embodiment, the displacement-output-transfer member 173-1 includes a screw 174-1, as shown in FIG. 17. The screw 174-1 connects the drive rod 103*a*1 to the excitation point P1 specified on the acrylic plate 102B. Namely, the screw 174-1, which is a stick-like member, penetrates the drive rod 103*a*1 and the acrylic plate 102B so that the drive rod 103*a*1 and the acrylic plate 102B are fastened to each other by using the screw 174-1. In that case, a penetration hole where the screw part of the screw 174-1 passes through is provided at the position corresponding to the excitation point P1 specified on the acrylic plate 102B, and a screw hole with a female-screw thread cut therein is provided in the drive rod 103*a*1.

A displacement-output-transfer member 173-2 is provided between the drive rod 103*a*2 of the magnetostrictive actuator 103C and the acrylic plate 102B. The displacement-output-transfer member 173-2 connects the drive rod 103*a*2 to excitation point P2, which is the second point specified on the face of the acrylic plate 102B. In that case, the displacement output of the magnetostrictive actuator 103C is transferred to the excitation point P2 specified on the acrylic plate 102B via the displacement-output-transfer member 173-2. Therefore, it becomes possible to excite the acrylic plate 102B from the excitation point P2 in the face direction according to the displacement output of the actuator 103C.

In the above-described embodiment, the displacement-output-transfer member 173-2 includes a screw 174-2, as shown in FIG. 17. The screw 174-2 connects the drive rod 103*a*2 to the excitation point P2 specified on the acrylic plate 102B. Namely, the screw 174-2, which is a stick-like member, penetrates the drive rod 103*a*2 and the acrylic plate 102B so that the drive rod 103*a*2 and the acrylic plate 102B are fastened to each other by using the screw 174-2. In that case, a penetration hole where the screw part of the screw 174-2 passes through is provided at the position corresponding to the excitation point P2 specified on the acrylic plate 102B, and a screw hole with a female-screw thread cut therein is provided in the drive rod 103*a*2.

The magnetostrictive actuator 103C is driven by the high-frequency component SAH of a sound signal by the above-described driving system shown in FIG. 8, for example, and the drive rods 103*a*1 and 103*a*2 is displaced according to the high-frequency component SAH, so as to be mutually axisymmetrical. For example, when the drive rod 103*a*1 is displaced in an upward direction, the drive rod 103*a*2 is displaced in a downward direction. On the contrary, when the drive rod 103*a*1 is displaced in the downward direction, the drive rod 103*a*2 is displaced in the upward direction.

Other details on the speaker device 100C are the same as those of the speaker device 100B shown in FIGS. 12 to 14.

Operations of the speaker device 100C shown in FIGS. 15 and 16 will be described.

The magnetostrictive actuators 103C fixed to the acrylic plate 102B is driven by the high-frequency component SAH of the monaural-sound signal SA, for example, and the drive rods 103*a*1 and 103*a*2 of the magnetostrictive actuator 103C are displaced according to the high-frequency component SAH, so as to be mutually axisymmetrical. Displacements of the drive rods 103*a*1 and 103*a*2 (the displacement output of the actuator 103C) are transferred to the excitation points P1 and P2 specified on the acrylic plate 102B via the displacement-output-transfer members 173-1 and 173-2. Therefore, the acrylic plate 102B is excited in the face direction from the excitation points P1 and P2 according to the displacement output of the actuator 103C.

In that case, each of the excitation points P1 and P2 specified on the acrylic plate 102B is excited by a longitudinal wave so that elastic waves (vibrations) are propagated through the acrylic plate 102B in the face direction. Then, when each of the elastic waves is propagated through the acrylic plate 102B, the mode is changed repeatedly so that longitudinal waves and transverse waves are generated alternately. Subsequently, a mixed wave including the longitudinal wave and the transverse wave is generated, and a vibration in the in-face direction (a direction vertical to the face) of the acrylic plate 102B is excited by the transverse wave so that a sound wave is emitted from each of one and the other faces of the acrylic plate 102B. Namely, the high-frequency-sound output corresponding to the high-frequency component SAH can be obtained from the outer face of the acrylic plate 102B. Here, operations relating to the speaker unit 104 are the same as those of the speaker device 101B shown in FIGS. 12 to 14.

According to the speaker device 100C shown in FIGS. 15 and 16, the magnetostrictive actuator 103C driven by the high-frequency component SAH of the monaural-sound signal SA, for example, excites the acrylic plate 102B from the excitation points P1 and P2 in the face direction, as is the case with the speaker device 100A shown in FIGS. 1 to 4. Therefore, no large transverse wave occurs at each of the excitation points P1 and P2 so that a sound wave emitted from each of the excitation points P1 and P2 is not heard, as a sound significantly louder than a sound wave emitted from another position. Therefore, it becomes possible to localize a sound image over the entire face of the acrylic plate 102B, and a sound image with the spaciousness feeling can be obtained.

Further, according to the speaker device 100C shown in FIGS. 15 and 16, the displacement output of the magnetostrictive actuator 103C is transferred to each of the excitation points P1 and P2 determined on the face of the acrylic plate 102B via the displacement-output-transfer members 173-1 and 173-2. Therefore, the displacement output of the magnetostrictive actuator 103C can be transferred to the acrylic plate 102B more correctly than in the case where each of the drive rods 103*a*1 and 103*a*2 of the magnetostrictive actuator 103C simply abuts the end face of the acrylic plate 102B, and a sound output faithful to a sound signal can be obtained from the acrylic plate 102B.

Further, according to the speaker device 100C shown in FIGS. 15 and 16, the magnetostrictive actuator 103C includes the drive rods 103*a*1 and 103*a*2 that are displaced, so as to be mutually axisymmetrical, and displacement outputs obtained by the drive rods 103*a*1 and 103*a*2 are transferred to the excitation points P1 and P2 specified on the acrylic plate 102B via the displacement-output-transfer members 173-1 and 173-2. Since the number of points where a single magnetostrictive actuator excites an acoustic diaphragm (the acrylic plate 102B) becomes two, the feeling of spaciousness of a sound image can further be increased.

Figure 18:
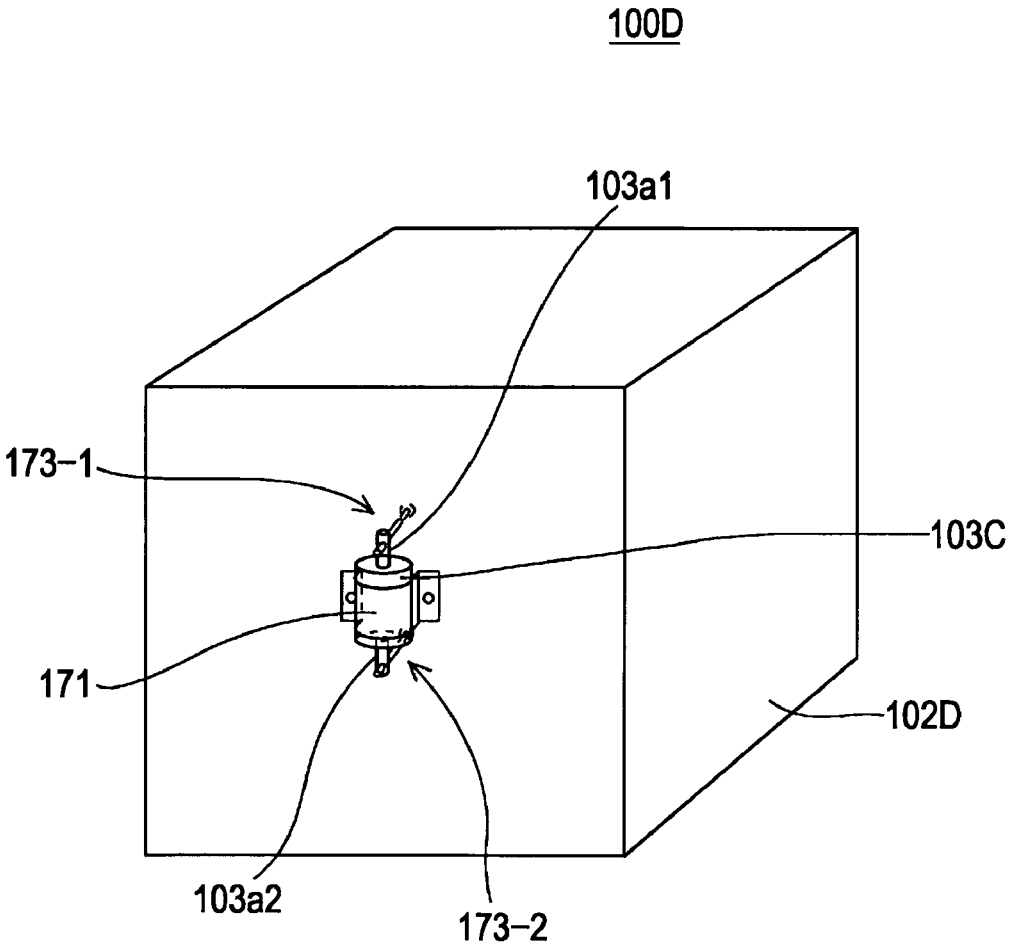
FIG. 18 is a perspective view of a speaker device according to another embodiment of the present invention.
Figure 19:
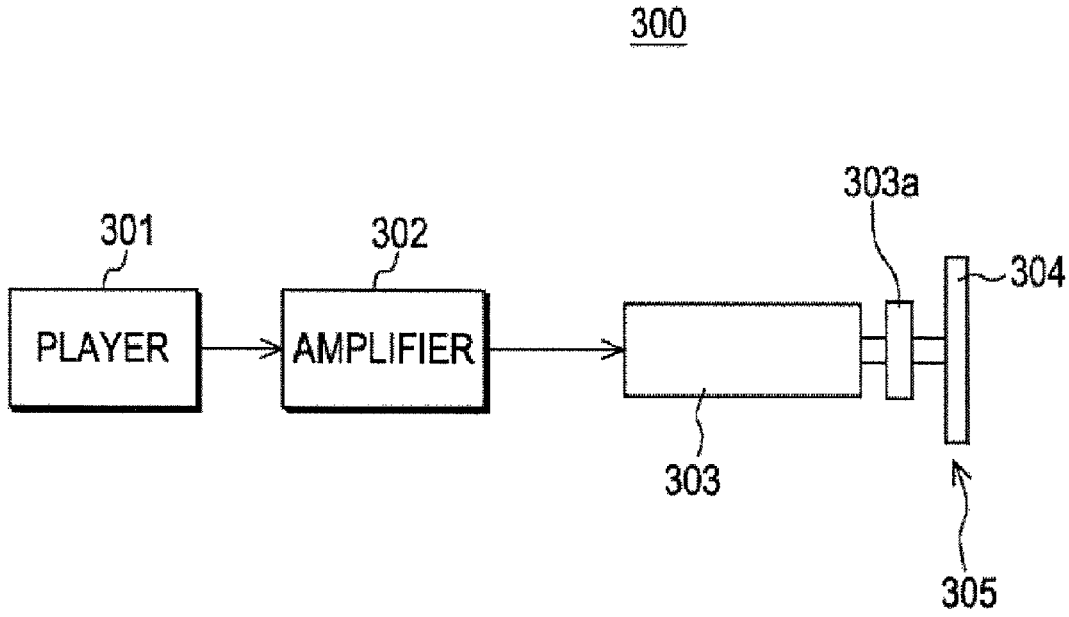
FIG. 19 (Prior Art)
FIG. 19 is a block diagram showing an example configuration of a sound-output device using a magnetostrictive actuator.

FIG. 18 shows the configuration of a speaker device 100D according to another embodiment of the present invention. FIG. 18 is a perspective view of the speaker device 100D.

According to the speaker device 100D, the magnetostrictive actuator 103C is fixed to one of faces of a box-shaped acoustic diaphragm 102D. The fixing of the magnetostrictive actuator 103C to the acoustic diaphragm 102D is performed in the same manner as that in which the magnetostrictive actuator 103C is fixed to the acrylic plate 102B in the above-described speaker device 100C shown in FIGS. 15 and 16.

Further, as in the case where the drive rods 103*a*1 and 103*a*2 of the magnetostrictive actuator 103C of the above-described speaker device 100C shown in FIGS. 15 and 16 are connected to the acrylic plate 102B, the drive rods 103*a*1 and 103*a*2 of the magnetostrictive actuator 103C are respectively connected to the excitation points P1 and P2 that are separated from each other and that are specified on the acoustic diaphragm 102D through the use of the displacement-output-transfer members 173-1 and 173-2.

Operations of the speaker device 100D shown in FIG. 18 will be described.

The magnetostrictive actuator 103C fixed to the acoustic diaphragm 102D is driven by a monaural-sound signal, for example, and the drive rods 103*a*1 and 103*a*2 of the magnetostrictive actuator 103C are displaced according to the sound signal, so as to be mutually axisymmetrical. Displacements of the drive rods 103*a*1 and 103*a*2 (the displacement output of the actuator 103C) are transferred to the excitation points P1 and P2 specified on the acoustic diaphragm 102D via the displacement-output-transfer members 173-1 and 173-2. Therefore, the acoustic diaphragm 102D is excited in the face direction from the excitation points P1 and P2 according to the displacement output of the magnetostrictive actuator 103C.

In that case, each of the excitation points P1 and P2 specified on the acoustic diaphragm 102D is excited by a longitudinal wave so that an elastic wave (vibration) is propagated through the acoustic diaphragm 102D in the face direction. Then, when the elastic wave is propagated through each of faces of the acoustic diaphragm 102D, the mode is changed repeatedly so that longitudinal waves and transverse waves are generated alternately. Subsequently, a mixed wave including the longitudinal wave and the transverse wave is generated, and a vibration generated in the in-face direction (a direction vertical to the face) of the acoustic diaphragm 102D is excited by the transverse wave so that a sound wave is emitted from each of the faces of the box-shaped acoustic diaphragm 102D. Namely, the sound output corresponding to a sound signal can be obtained from each of the faces of the acoustic diaphragm 102D.

According to the speaker device 100D shown in FIG. 18, the magnetostrictive actuator 103C driven by a sound signal excites the box-shaped acoustic diaphragm 102D in the face direction from the excitation points P1 and P2, as is the case with the speaker device 100A shown in FIGS. 1 to 4. Therefore, no large transverse wave occurs at each of the excitation points P1 and P2 so that a sound wave emitted from each of the excitation points P1 and P2 is not heard, as a sound significantly louder than a sound wave emitted from another position. Therefore, it becomes possible to localize a sound image over each of the faces of the box-shaped acoustic diaphragm 102D, and a sound image with the spaciousness feeling can be obtained.

Further, according to the speaker device 100D shown in FIG. 18, the displacement output of the magnetostrictive actuator 103C is transferred to each of the excitation points P1 and P2 specified on the face of the box-shaped acoustic diaphragm 102D via the displacement-output-transfer members 173-1 and 173-2. Therefore, the displacement output of the magnetostrictive actuator 103C can be transferred to the acoustic diaphragm 102D more correctly than in the case where each of the drive rods 103*a*1 and 103*a*2 of the magnetostrictive actuator 103C simply abuts the end face of a rectangular and/or cylindrical acoustic diaphragm, and a sound output faithful to a sound signal can be obtained from the acoustic diaphragm 102D.

Further, according to the speaker device 100D shown in FIG. 18, the displacement output of the magnetostrictive actuator 103C is transferred to each of the excitation points P1 and P2 specified on the face of the box-shaped acoustic diaphragm 102D via the displacement-output-transfer members 173-1 and 173-2. Therefore, it becomes possible to appropriately transfer the displacement output of the magnetostrictive actuator 103C to the box-shaped acoustic diaphragm 102D with no end face and excite the box-shaped acoustic diaphragm 102D in the face direction.

Further, according to the speaker device 100D shown in FIG. 18, the magnetostrictive actuator 103C includes the drive rods 103*a*1 and 103*a*2 that are displaced, so as to be mutually axisymmetrical, and displacement outputs obtained by the drive rods 103*a*1 and 103*a*2 are transferred to the excitation points P1 and P2 specified on the acoustic diaphragm 102D via the displacement-output-transfer members 173-1 and 173-2. Since the number of points where the single magnetostrictive actuator excites the acoustic diaphragm 102D becomes two, the spaciousness feeling of a sound image can further be increased.

For the above-described speaker devices 100A to 100D, the cylindrical acoustic diaphragm, the flat-shaped acoustic diaphragm, and the box-shaped acoustic diaphragm are used. However, the present invention can also be used for an acoustic diaphragm of another shape, such as a globular acoustic diaphragm, for example. When an acoustic diaphragm with no end face is used, the displacement-output-transfer member used in each of the above-described speaker devices 100B to 100D may be used, for example.

Further, according to each of the above-described embodiments, the magnetostrictive actuator is used, as an actuator configured to excite the acoustic diaphragm. However, a different actuator including an electrodynamic actuator, a piezoelectric actuator, etc. can be used, so as to achieve the same speaker device as those described in the above-described embodiments.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker device comprising:

an acoustic-vibration member;

an actuator that is driven based on a sound signal and that includes a displacement-output unit that can obtain a displacement corresponding to the sound signal; and a displacement-output-transfer member configured to connect the displacement-output unit to a predetermined point on a face of the acoustic-vibration member, the displacement-output-transfer member including an approximately U-shaped member connected to the displacement-output unit and a stick-like member configured to penetrate the approximately U-shaped member and the acoustic-vibration member when an end part of the acoustic-vibration member is inserted into the approximately U-shaped member so that the approximately U-shaped member and the acoustic-vibration member are connected to each other, wherein a displacement output of the actuator is transferred to the predetermined point via the displacement-output-transfer member, and the acoustic-vibration member is excited in a face direction from the predetermined point according to the displacement output.

2. The speaker device according to claim 1, further comprising an energizing structure configured to energize the actuator in the face direction at all times.

3. The speaker device according to claim 1, wherein the displacement-output unit comprises a first displacement-output unit provided on one end side and a second displacement-output unit provided on another end side; and the displacement-output-transfer member comprises a first displacement-output-transfer member connecting the first displacement-output unit to a first point determined on the face of the acoustic-vibration member, and a second displacement-output-transfer member connecting the second displacement-output unit to a second point determined on the face of the acoustic-vibration member.

4. The speaker device according to claim 1, wherein:

the actuator is one of a plurality of actuators;

the displacement-output-transfer members is one of a plurality of displacement-output-transfer members, so as to be ready for the plurality of actuators; and the plurality of displacement-output-transfer members transfer displacement outputs of the plurality of actuators to different points determined on the face of the acoustic-vibration member.

5. The speaker device according to claim 1, wherein the acoustic-vibration member comprises a cylindrical acoustic diaphragm.

6. The speaker device according to claim 1, wherein the actuator comprises at least one of a magnetostrictive actuator, an electrodynamic actuator and a piezoelectric actuator.

7. The speaker device according to claim 6, wherein the actuator comprises a magnetostrictive actuator comprising:

a stick-like magnetostrictive element, a solenoid coil disposed around the magnetostrictive element, the solenoid coil adapted to apply a control magnetic field to the magnetostrictive element, a drive rod connected to a first end of the magnetostrictive element, the drive rod constructed and arranged to provide a displacement output of the magnetostrictive actuator, a fixed plate connected to a second end of the magnetostrictive element, the fixed plate constructed and arranged to support the magnetostrictive element, an accommodation unit disposed around the magnetostrictive element including a cylindrical case and a permanent magnet disposed adjacent to the cylindrical case, the permanent magnet adapted to apply a static bias magnetic field to the magnetostrictive element, wherein a gap is provided between the drive rod and the accommodation unit.

8. The speaker device according to claim 7, wherein the drive rod, the fixed plate and the cylindrical case each comprise a ferromagnet.

9. A speaker device comprising:

a cylindrical acoustic-vibration member;

an actuator that is driven based on a sound signal and that includes a displacement-output unit that can obtain a displacement corresponding to the sound signal; and a displacement-output-transfer member configured to connect the displacement-output unit to a predetermined point on a face of the acoustic-vibration member, wherein a displacement output of the actuator is transferred to the predetermined point via the displacement-output-transfer member, and the acoustic-vibration member is excited in a face direction from the predetermined point according to the displacement output;

wherein the displacement-output-transfer member includes:

an approximately U-shaped member connected to the displacement-output unit; and a stick-like member configured to penetrate the approximately U-shaped member and the acoustic-vibration member when an end part of the acoustic-vibration member is inserted into the approximately U-shaped member so that the approximately U-shaped member and the acoustic-vibration member are connected to each other.

10. The speaker device according to claim 9, wherein the cylindrical acoustic-vibration member comprises a cylindrical acoustic diaphragm.

11. The speaker device according to claim 9, further comprising an energizing structure configured to energize the actuator in the face direction at all times.

12. The speaker device according to claim 9, wherein the displacement-output unit comprises a first displacement-output unit provided on one end side and a second displacement-output unit provided on another end side; and the displacement-output-transfer member comprises a first displacement-output-transfer member connecting the first displacement-output unit to a first point determined on the face of the acoustic-vibration member, and a second displacement-output-transfer member connecting the second displacement-output unit to a second point determined on the face of the acoustic-vibration member.

13. The speaker device according to claim 9, wherein:

the actuator is one of a plurality of actuators;

the displacement-output-transfer members is one of a plurality of displacement-output-transfer members, so as to be ready for the plurality of actuators; and the plurality of displacement-output-transfer members transfer displacement outputs of the plurality of actuators to different points determined on the face of the acoustic-vibration member.

14. The speaker device according to claim 9, wherein the actuator comprises at least one of a magnetostrictive actuator, an electrodynamic actuator and a piezoelectric actuator.

15. The speaker device according to claim 14, wherein the actuator comprises a magnetostrictive actuator comprising:

a stick-like magnetostrictive element, a solenoid coil disposed around the magnetostrictive element, the solenoid coil adapted to apply a control magnetic field to the magnetostrictive element, a drive rod connected to a first end of the magnetostrictive element, the drive rod constructed and arranged to provide a displacement output of the magnetostrictive actuator, a fixed plate connected to a second end of the magnetostrictive element, the fixed plate constructed and arranged to support the magnetostrictive element, an accommodation unit disposed around the magnetostrictive element including a cylindrical case and a permanent magnet disposed adjacent to the cylindrical case, the permanent magnet adapted to apply a static bias magnetic field to the magnetostrictive element, wherein a gap is provided between the drive rod and the accommodation unit.

* * * * *